US006450144B2

(12) United States Patent
Janak et al.

(10) Patent No.: US 6,450,144 B2
(45) Date of Patent: Sep. 17, 2002

(54) METHOD AND APPARATUS FOR HYDRAULIC CLIP AND RESET OF ENGINE BRAKE SYSTEMS UTILIZING LOST MOTION

(75) Inventors: Robb Janak, Somers, CT (US); Stephen Lak, West Springfield; Michael Bergmann, South Hadley, both of MA (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/739,960

(22) Filed: Dec. 20, 2000

Related U.S. Application Data

(60) Provisional application No. 60/172,581, filed on Dec. 20, 1999.

(51) Int. Cl.[7] ..... F02D 13/04; F01L 1/34

(52) U.S. Cl. ..... 123/321; 123/90.16

(58) Field of Search ..... 123/320, 321, 123/322, 323, 324, 90.12, 90.13, 90.16, 90.46

(56) References Cited

U.S. PATENT DOCUMENTS

| | | | | |
|---|---|---|---|---|
| 3,220,392 A | | 11/1965 | Cummins | 123/321 |
| 3,786,792 A | | 1/1974 | Pelizzoni et al. | 123/90.16 |
| 3,809,033 A | | 5/1974 | Cartledge | 123/90.46 |
| 4,399,787 A | | 8/1983 | Cavanagh | 123/321 |
| 4,572,114 A | | 2/1986 | Sickler | 123/21 |
| 4,724,801 A | | 2/1988 | O'Neill | 123/90.12 |
| 5,036,810 A | | 8/1991 | Meneely | 123/321 |
| 5,146,890 A | | 9/1992 | Gobert et al. | 123/321 |
| 5,495,838 A | | 3/1996 | Johnson, Jr. | 123/322 |
| 5,507,261 A | | 4/1996 | Johnson, Jr. | 123/322 |
| 5,564,385 A | | 10/1996 | Hakansson | 123/321 |
| 5,586,531 A | | 12/1996 | Vittorio | 123/320 |
| 5,609,133 A | | 3/1997 | Hakansson | 123/321 |
| 5,626,116 A | | 5/1997 | Reedy et al. | 123/321 |
| 5,647,318 A | | 7/1997 | Feucht et al. | 123/322 |
| 5,680,841 A | | 10/1997 | Hu | 123/322 |
| 5,839,453 A | | 11/1998 | Hu | 123/322 |
| 5,890,469 A | * | 4/1999 | Hakansson et al. | 123/321 |
| 5,975,251 A | | 11/1999 | McCarthy | 123/321 |
| 6,000,374 A | | 12/1999 | Cosma et al. | 123/321 |
| 6,125,828 A | * | 10/2000 | Hu | 123/321 |
| 6,152,104 A | * | 11/2000 | Vorih et al. | 123/321 |
| 6,253,730 B1 | * | 7/2001 | Gustafson | 123/321 |

FOREIGN PATENT DOCUMENTS

EP 0 593 908 A1 9/1993

* cited by examiner

*Primary Examiner*—Willis R. Wolfe
(74) *Attorney, Agent, or Firm*—David R. Yohannan; Collier Shannon Scott, PLLC

(57) ABSTRACT

An internal combustion engine may include a hydraulic linkage used to transfer motion from a valve train element, such as a cam, to an engine valve. Method and apparatus for selectively limiting the motion transferred by the hydraulic linkage from the valve train element to the engine valve are disclosed. The motion transferred by the hydraulic linkage may be limited by a means for resetting or clipping that is integrated into the rocker arm/shaft assembly provided in the valve train.

38 Claims, 21 Drawing Sheets

METHOD AND APPARATUS FOR HYDRAULIC CLIP AND RESET OF ENGINE BRAKE SYSTEMS UTILIZING LOST MOTION

CROSS REFERENCE TO RELATED APPLICATIONS

The application relates to and claims priority on U.S. Provisional Pat. App. Ser. No. 60/172,581, filed on Dec, 20, 1999.

FIELD OF THE INVENTION

The present invention relates generally to valve actuation in internal combustion engines that include compression release-type engine retarders. In particular, it relates to methods and apparatus for controlling valve lift and duration for compression release valve events and main exhaust valve events.

BACKGROUND OF THE INVENTION

Engine retarders or brakes of the compression release-type are well-known in the art. Engine retarders are designed to convert, at least temporarily, an internal combustion engine of compression-ignition type into an air compressor. In doing so, the engine develops retarding horsepower to help slow the vehicle down. This can provide the operator increased control over the vehicle and substantially reduce wear on the service brakes of the vehicle. A properly designed and adjusted compression release-type engine retarder can develop retarding horsepower that is a substantial portion of the operating horsepower developed by the engine in positive power.

Functionally, compression release-type retarders supplement the braking capacity of the primary vehicle wheel braking system. In so doing, it extends substantially the life of the primary (or wheel) braking system of the vehicle. The basic design for a compression release engine retarding system of the type involved with this invention is disclosed in Cummins, U.S. Patent No. 3,220,392 (November 1965) for a Vehicle Engine Braking And Fuel Control System.

The compression release-type engine retarder disclosed in the Cummins '392 patent employs a hydraulic system or linkage. The hydraulic linkage of a typical compression release-type engine retarder may be linked to the valve train of the engine. When the engine is under positive power, the hydraulic linkage may be disabled from providing valve actuation. When compression release-type retarding is desired, the hydraulic linkage is enabled such that valve actuation is provided by the hydraulic linkage responsive to an input from the valve train.

Among the hydraulic linkages that have been employed to control valve actuation (both in braking and positive power), are so-called "lost-motion" systems. Lost-motion, per se, is not new. It has been known that lost-motion systems are useful for variable valve control for internal combustion engines for decades. In general, lost-motion systems work by modifying the hydraulic or mechanical circuit connecting the actuator (typically the cam shaft) and the valve stem to change the length of that circuit and lose a portion or all of the cam actuated motion that would otherwise be delivered to the valve stem to produce a valve opening event. In this way lost-motion systems may be used to vary valve event timing, duration, and the valve lift.

Compression release-type engine retarders may employ a lost motion system in which a lash piston is included in the valve train (e.g. a linkage of a push tube, cam, and/or rocker arm) of the engine. When the retarder is engaged, the lash piston is hydraulically extended to cause the exhaust valve of the internal combustion engine to open at a point near the end of a piston's compression stroke. In doing so, the work that is done in compressing the intake air cannot be recovered during the subsequent expansion (or power) stroke of the engine. Instead, it is dissipated through the exhaust and radiator systems of the engine. By dissipating energy developed from the work done in compressing the cylinder gases, the compression release-type retarder dissipates the kinetic energy of the vehicle, which may be used to slow the vehicle down.

Regardless of the specific actuation means chosen, inherent limits were imposed on operation of the compression release-type retarder based on engine parameters. One such engine parameter is the physical relationship of an engine cylinder valve used for compression release braking and the piston in the same cylinder. If the extension of the valve into the cylinder was unconstrained during compression release braking, the valve could extend so far down into the cylinder that it impacts with the piston in the cylinder.

There may be a significant risk of valve-to-piston contact when a unitary cam lobe is used to impart the valve motion for both the compression release valve event and the main exhaust valve event. Use of a unitary cam lobe for both events means that the relatively large main exhaust lobe motion will be imparted to the hydraulic linkage, or more particularly to the slave piston. Because there is typically little or no lash between the lash piston and the exhaust valve during engine braking, input of the main exhaust event motion to the lash piston may produce a greater than desired main exhaust event. A means for limiting the downward stroke of an exhaust valve for its main exhaust event during engine braking is needed.

Some systems do not use a unitary cam lobe for both the compression release valve event and the main exhaust valve event. These systems may operate using a dedicated braking cam lobe to drive a dedicated braking rocker arm, and a dedicated main exhaust cam lobe to drive a dedicated main exhaust rocker arm. The braking and main exhaust rocker arms may actuate different or the same exhaust valves using one or more bridges or similar arrangements to convey the rocker arm motions to the selected exhaust valves. Although these "dedicated" systems do not run the same risks of valve-to-piston contact as the "unitary cam" systems, they may also benefit from inclusion of a means to limit the downward stroke of the exhaust valves.

One way of limiting the downward stroke of an exhaust valve used for compression release valve events and/or main exhaust valve events is to limit the extension of the hydraulic lash piston that is responsible for pushing the valve into the cylinder during compression release braking. A device that may be used to limit piston extension or motion is disclosed in Cavanagh, U.S. Pat. No. 4,399,787 (Aug. 23, 1983) for an Engine Retarder Hydraulic Reset Mechanism, which is incorporated herein by reference. Another device that may be used to limit piston motion is disclosed in Hu, U.S. Pat. No. 5,201,290 (Apr. 13, 1993) for a Compression Relief Engine Retarder Clip Valve, which is also incorporated herein by reference. Both of these (reset valves and clip valves) may comprise means for blocking a passage in a lash piston during the downward movement of the lash piston (such as the passage 344 of the slave piston 340 of FIG. 6). After the lash piston reaches a threshold downward displacement, the reset valve or clip valve may unblock the passage through it and allow the oil displacing it to drain there through, causing the lash piston to return to its upper position under the influence of a return spring.

A reset valve, such as the one disclosed in Cavanagh, may be provided as part of a lash adjuster or a lash piston. A reset valve may comprise a hydraulically actuated means for unblocking a passage through the lash piston to limit its displacement. In Cavanagh, compression release retarding is carried out by opening one of two valves connected by a crosshead member or bridge. A purpose of the reset valve used in Cavanagh is to reseat the exhaust valve used for the compression release event before a subsequent main exhaust valve event so that the rocker arm will not push down on an unbalanced crosshead during the main exhaust event and transmit a bending force to the crosshead guide pin or to the non-braking valve stem.

A clip valve, such as the one disclosed in Hu, may comprise a mechanically actuated means for unblocking the passage through a hydraulically extendable piston to limit its extension.

As evident from the foregoing, compression release retarding systems have historically been implemented as bolt-on systems added to an existing engine as an optional or after-market item. As the market for compression release-type engine retarders has developed and matured, the direction of technological development has moved away from bolt-on systems towards compact, cost-efficient integrated engine braking systems. More and more engine manufacturers have expressed an interest in incorporating or integrating the engine brake components into their fundamental engine designs in order to achieve their cost and performance goals. It is believed that incorporation of the engine brake into the engine will ultimately provide the needed cost, weight, performance, and efficiency benefits.

One method of engine brake integration is disclosed in Cartledge, U.S. Pat. No. 3,809,033 (May 7, 1974) for a Rocker Arm Engine Brake System. With reference to FIGS. 6–8 of Cartledge, a rocker arm 16 incorporates a lash piston 31 that may be hydraulically extended from the rocker arm for braking operation. The rocker arm transfers braking motion from a cam (not shown) to an exhaust valve 15. The lash piston 31 takes up the lash between the rocker arm 16 and its associated exhaust valve during engine braking. The elimination of this lash during braking allows a small braking lobe on the exhaust cam to produce a compression release opening of the exhaust valve near the top of the piston compression stroke.

A more recent development of the rocker arm brake is disclosed in McCarthy, U.S. Pat. No. 5,975,251 (Nov. 2, 1999) for a Rocker Brake Assembly With Hydraulic Lock, which is incorporated herein by reference. With reference to FIG. 1 of McCarthy, a rocker arm assembly 10 having a brake rocker arm 100 mounted on a rocker shaft 200 is shown. The brake rocker arm 100 pivots about the rocker shaft 200 and includes a first end 110 and a second end 120. The first end 110 of the brake rocker arm 100 includes a brake cam lobe follower 111. The brake cam lobe follower 111 may include a roller 112 that is in contact with a brake cam lobe, not shown. The second end 120 of the brake rocker arm 100 includes an actuator assembly 121. The actuator assembly 121 is spaced from the crosshead of an exhaust rocker arm, not shown. When activated, the brake rocker arm 100 and the actuator assembly 121 contact the crosshead pin, not shown, of the crosshead to open the at least one exhaust valve to perform a braking operation. The brake rocker arm 100 also includes a fluid passageway 130 that extends from the actuator assembly 121. Hydraulic fluid from a passageway 210 in the shaft 200 may be supplied to the fluid passageway 130 to operate the actuator assembly 121.

Furthermore, both current and expected environmental restrictions have forced engine manufacturers to explore a variety of new ways to improve the efficiency of their engines. These changes have forced a number of engine modifications. Engines have become smaller and more fuel efficient, increasing the need for weight saving integration of engine brakes. Yet, the demands on retarder performance have often increased, requiring the compression release-type engine retarder to generate greater amounts of retarding horsepower under more limiting conditions.

In view of the foregoing, there is a need for an integrated engine braking system and method of operation therefor, that includes a lash piston that may be hydraulically reset and/or clipped. In particular, there is a need for an engine braking system having a lash piston and a means for resetting or clipping the lash piston integrated into a rocker arm assembly.

OBJECTS OF THE INVENTION

It is therefore an object of the present invention to provide an actuation means for engine braking that optimizes engine retarding performance.

It is another object of the present invention to provide a system and method for avoiding valve-to-piston contact during a main exhaust valve event.

It is a further object of the present invention to provide a system and method for limiting the stroke of a lash piston during an engine valve opening event.

It is yet another object of the present invention to provide a system and method for resetting a lash piston following an engine valve opening event.

It is still another object of the present invention to provide a system and method for clipping the motion of a lash piston during an engine valve opening event.

It is still a further object of the present invention to provide a system and method of engine braking that is integrated into the rocker arm/shaft assembly.

Additional objects and advantages of the invention are set forth, in part, in the description which follows, and, in part, will be apparent to one of ordinary skill in the art from the description and/or from the practice of the invention.

SUMMARY OF THE INVENTION

In response to this challenge, Applicants have developed an innovative and reliable engine braking system, for providing a compression release valve event in an internal combustion engine, comprising: a rocker arm shaft; a rocker arm having a central bore adapted to receive the rocker arm shaft; means for pivoting the rocker arm on the rocker arm shaft to provide a compression release valve event; an hydraulically extendable lash piston disposed in a piston bore in the rocker arm, said lash piston being adapted to open an engine valve for the compression release event; means for providing hydraulic fluid to the piston bore; an hydraulic relief port provided on the rocker arm, said relief port having hydraulic communication with the piston bore; and means for selectively unblocking the relief port responsive to pivoting of the rocker arm.

Applicants have also developed an engine braking system, for providing a compression release valve event in an internal combustion engine, comprising: a rocker arm shaft; an hydraulic relief passage formed in the rocker arm shaft, said relief passage communicating with an outer surface of the rocker arm shaft; a rocker arm having a central bore adapted to receive the rocker arm shaft; means for pivoting the rocker arm on the rocker arm shaft to provide a compression release valve event; an expandable hydraulic tappet disposed in a piston bore in the rocker arm, said tappet being adapted to open an engine valve for the compression release event; means for providing hydraulic fluid to the tappet; and means for providing selective hydraulic communication between the relief passage and the tappet responsive to pivoting of the rocker arm.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

DETAILED DESCRIPTION OF THE PREFERRED EMBODIMENTS

Figure 1:
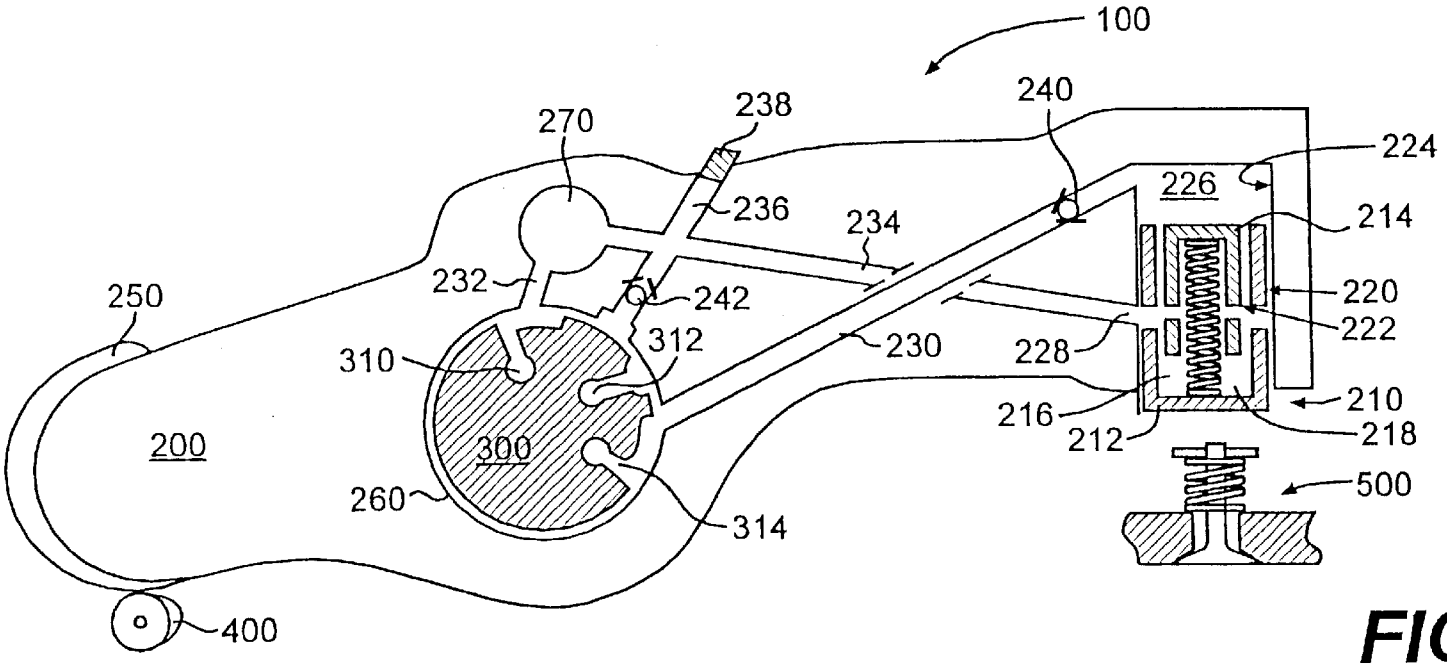
FIGS. 1–19 and 21–22 are cross-sectional views in elevation and top plan of eleven related alternative embodiments of the invention.
Figure 2:
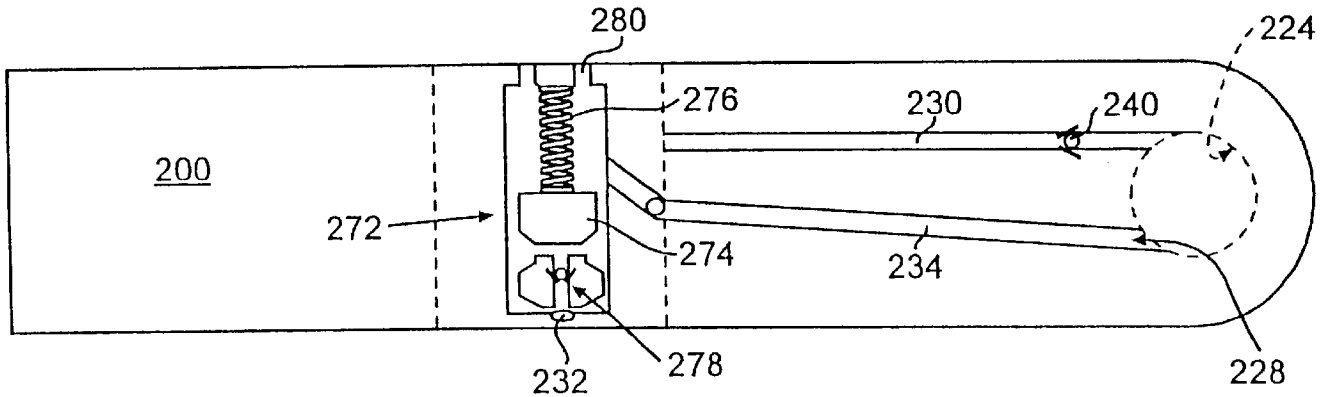

Reference will now be made in detail to the various embodiments of the present invention, examples of which are illustrated in the accompanying drawings and in which like reference numerals refer to like elements. A first embodiment of the present invention is shown in FIGS. 1 and 2 as engine braking system 100. Generally, the engine braking system 100, exemplified by the system shown in FIGS. 1 and 2, may include an operative arrangement of a rocker arm 200, a rocker arm shaft 300, a means for imparting motion to the rocker arm 400, and an engine valve assembly 500. A lash piston 210 may be formed in an end of the rocker arm 200. The arrangement of one or more hydraulic passages formed in the rocker arm 200 provide for the selective relief of hydraulic fluid from the lash piston 210 responsive to pivoting of the rocker arm on the rocker arm shaft 300. When the lash piston 210 is in contact with the engine valve assembly 500, the relief of hydraulic fluid from the lash piston may be used to clip or reset the motion of the engine valve.

In each of the various embodiments of the invention, the motion provided by the rocker arm 200 to an engine valve from an auxiliary lobe on the cam may be selectively absorbed by any one of three different methods. In a first method, the rocker arm 200 may include a tappet designed to internally collapse a preselected distance that will result in absorption of the auxiliary event. In a second method, the rocker arm (or a hydraulic passage communicating therewith) may include an accumulator having a fixed travel designed to absorb the auxiliary event. In a third method, the rocker arm may include a lash adjustment screw that may be set to limit the travel of a piston extending out of the rocker arm so as to provide for loss of the auxiliary event.

A detailed explanation of the embodiment of the invention shown in FIGS. 1 and 2, and its operation, will now be provided. The rocker arm 200 includes a lash piston 210 at a first end and a cam follower 250 at a second end. The cam follower 250 is rotatable so that the rotary motion of the cam 400 may be converted into a pivoting motion by the rocker arm 200 with minimal friction. The means for imparting motion to the rocker arm is a cam 400 in the system shown in FIG. 1. When the engine valve 500 is implemented as an exhaust valve or dedicated braking valve, the cam 400 may have fixed compression release, main exhaust, and/or EGR lobes formed thereon.

The means for imparting motion may include a push tube, or other valve train element between the cam 400 and the rocker arm 200 without departing from the scope of the invention. While preferred, the cam 400 is not critical to the invention, and it is within the scope of the invention for the means for imparting motion to the rocker arm 200 to be implemented without a cam.

The lash piston 210 may be implemented as a hydraulic tappet having an outer piston 212 and an inner piston 214. The outer and inner pistons may be biased apart by a spring 216 so that an interior hydraulic chamber 218 is formed. Hydraulic communication with the interior hydraulic chamber 218 may be made through one or more openings 220 and 222 in the walls of the outer and inner pistons 212 and 214, respectively.

The lash piston 210 is slidably disposed in a piston bore 224. An upper hydraulic chamber 226 is formed between the end of the piston bore 224 and the lash piston 210. The lash piston 210 may be biased into the piston bore 224 by the valve spring associated with the engine valve assembly 500.

The rocker arm 200 is pivotally mounted on a rocker arm shaft 300. The rocker arm shaft 300 is disposed in a central bore 260 formed in the rocker arm 200. A first hydraulic passage 230 formed in the rocker arm 200 connects the central bore 260 with the upper hydraulic chamber 226. A second hydraulic passage 232 connects the central bore 260 with a control valve bore 270. A third hydraulic passage 234 connects the control valve bore 270 with a port 228 in the wall of the piston bore 224. A fourth hydraulic passage 236 connects the central bore 260 with the third hydraulic passage 234. The fourth hydraulic passage 236 may be sealed from the atmosphere by a plug 238. The end of the fourth hydraulic passage 236 that intersects with the central bore 260 may be enlarged to provide an opening into the central bore of a predetermined size. A check valve 240 is disposed in the first hydraulic passage 230 so as to prevent back flow from the upper hydraulic chamber 226 to the central bore 260. A second check valve 242 is disposed in the fourth hydraulic passage 236 so as to prevent hydraulic flow from the central bore 260 to the third hydraulic passage 234.

With reference to FIG. 2, a control valve 272 is slidably disposed within the control valve bore 270. The control valve comprises a spool 274 biased towards the second hydraulic passage 232 by a spring 276. The spool 274 includes an internal hydraulic passage and check valve arrangement 278 that enables one way hydraulic flow from the second hydraulic passage 232 through the spool. One or more drain passages 280 may be provided in the end of the control valve bore 270.

The rocker arm shaft 300 may include multiple hydraulic passages adapted to provide hydraulic fluid to, and receive hydraulic fluid from, the passages in the rocker arm 200. A control passage 310 formed in the rocker arm shaft 300 provides hydraulic fluid to the second hydraulic passage 232 and the control valve 272. Hydraulic fluid may be provided to the control passage 310 under the control of a remotely located solenoid valve (not shown). A relief passage 312 formed in the rocker arm shaft 300 provides for selective relief of hydraulic pressure from the fourth hydraulic passage 236, the third hydraulic passage 234, and the tappet 210. A lash passage 314 formed in the rocker arm shaft 300 provides hydraulic fluid to the first hydraulic passage 230 and the upper hydraulic chamber 226.

With continued reference to FIGS. 1 and 2, the engine braking system 100 may be operated preferably with a cam 400 that includes at least a main exhaust lobe and a compression release lobe. During positive power operation of the engine in which the engine braking system 100 resides, low pressure hydraulic fluid in the lash passage 314 of the rocker arm shaft 300 is provided to the first hydraulic passage 230, past the check valve 240, and into the upper hydraulic chamber 226. The low pressure fluid in the upper hydraulic chamber 226 is prevented from escaping from the chamber by the check valve 240. The low pressure in the upper hydraulic chamber 226 is sufficient to cause the tappet 210 to extend downward as a unit until it contacts the engine valve assembly 500. The low pressure fluid in the upper hydraulic chamber 226 is not sufficient to open the engine valve assembly 500 against the force of the engine valve spring included therewith, nor is it sufficient to compress the spring 216 separating the inner piston 214 from the outer piston 212 in the tappet 210. In this manner, any lash space between the tappet 210 and the engine valve assembly 500 is automatically taken up without the need for mechanical adjustment.

With continued reference to operation during positive power, there is little or no hydraulic pressure provided in the control passage 310 in the rocker arm shaft 300 during positive power. The absence of significant pressure in the control passage 310 results in the continued biasing of the spool 274 into a "brake off" position by the spring 276, as shown in FIG. 2. When the spool 274 is in a "brake off" position, the hydraulic pressure within the interior hydraulic chamber 218 of the tappet 210 is free to dissipate through the third hydraulic passage 234 and out of the drain passages 280 to the atmosphere.

The absence of hydraulic fluid pressure in the tappet 210 results in the loss of the relatively small motion imparted to the rocker arm 200 by the compression release lobe of the cam 400 during positive power operation. The loss of pressure in the interior chamber 218 causes the inner piston 214 and the outer piston 212 to collapse and engage each other mechanically via the internal spring 216. The tappet 210 is dimensioned such that when it is collapsed the tappet is still of a size to transfer the main exhaust motion imparted by the cam 400 to the engine valve assembly 500. The tappet 210 is not of sufficient size in its collapsed state, however, to deliver the smaller compression release valve motion imparted by the cam 400. The compression release valve motion is "lost" by the compression of the spring 216 within the interior hydraulic chamber 218. In order for the compression release motion to be completely lost, the separation of the inner piston 214 from the outer piston 212 provided by the spring 216 must be at least as great as the magnitude of the compression release motion.

With continued reference to FIGS. 1 and 2, low pressure hydraulic fluid is provided to the control passage 310 in the rocker arm shaft 300 in order to institute engine braking. The low pressure fluid is provided to the control passage 310 under the control of a remote solenoid valve (not shown). Low pressure fluid from the control passage 310 flows through the second hydraulic passage 232 into the control valve bore 270 and displaces the spool 274 against the bias of the spring 276. Displacement of the spool 274 into a "brake on" position blocks the hydraulic communication between the third hydraulic passage 234 and the drain passage 280.

At the same time, displacement of the spool 274 places the third hydraulic passage 234 in hydraulic communication with second hydraulic passage 232. The low pressure fluid from the second hydraulic passage 232 flows through the internal hydraulic passage and check valve arrangement 278 in the spool 274, through the third hydraulic passage 234, and into the interior hydraulic chamber 218 of the tappet 210. The check valve 278 prevents the back flow of hydraulic fluid from the tappet 210 to the second hydraulic passage 232. Thus the length of the tappet 210 becomes hydraulically locked when the spool 274 is displaced into the "brake on" position and the cam 400 is at base circle.

The cam 400 does not remain at base circle for the entire engine cycle. As referenced above, the cam 400 may first impart a relatively small compression release pivoting motion to the rocker arm 200. This pivoting motion causes the rocker arm 200 to rotate relative to the fixed position of the rocker arm shaft 300. As the rocker arm rotates, the angular separation of the fourth hydraulic passage 236 and the relief passage 312 decreases. Rotation of the rocker arm 200 for compression release is not sufficient, however, to establish hydraulic communication between the fourth hydraulic passage 236 and the relief passage 312. The tappet 210 remains hydraulically locked at a fixed length throughout the compression release event, and accordingly, the entire compression release valve motion is transferred by the tappet to the engine valve assembly 500.

In addition to the compression release event, the cam 400 may also provide a main exhaust event. The pivoting motion imparted to the rocker arm 200 during the main exhaust event is larger than that for the compression release event. As the rocker arm 200 rotates for the main exhaust event, the angular separation of fourth hydraulic passage 236 and the relief passage 312 again decreases. Rotation of the rocker arm 200 for the main exhaust event, however, is sufficient to establish hydraulic communication between the fourth hydraulic passage 236 and the relief passage 312. Due to the high pressure on the tappet 210, the hydraulic communication between the fourth hydraulic passage 236 and the relief passage 312 causes the tappet 210 to collapse. The timing of the pressure release to the relief passage 312 determines whether the collapse of the tappet 210 will result in the engine valve motion being clipped or reset. The release of this pressure prior to the main exhaust event (i.e., at the end of the compression release event) results in a resetting (i.e. engine valve reseating) event; the release of this pressure during the main exhaust event results in a clipping event.

The hydraulic fluid collected by the relief passage 312 during the clipping or resetting event may be accumulated in an accumulator in the rocker arm shaft 300 or the rocker arm 200, or vented to atmosphere. Following the clipping or resetting event, the rocker arm 200 pivots in the reverse direction as it returns to the base circle of the cam 400. When the rocker arm 200 returns to base circle, the tappet 210 may refill with hydraulic fluid through the internal hydraulic passage and check valve arrangement 278 in the control valve 272.

The system 100 may be returned to its positive power configuration by actuating (or de-actuating, as the case may be) the remote solenoid to block the supply of low pressure hydraulic fluid to control valve 272. Hydraulic leakage past the spool 274 and out of the drain passage 280 allows the spool to return to its "brake off" position shown in FIG. 2.

Figure 3:
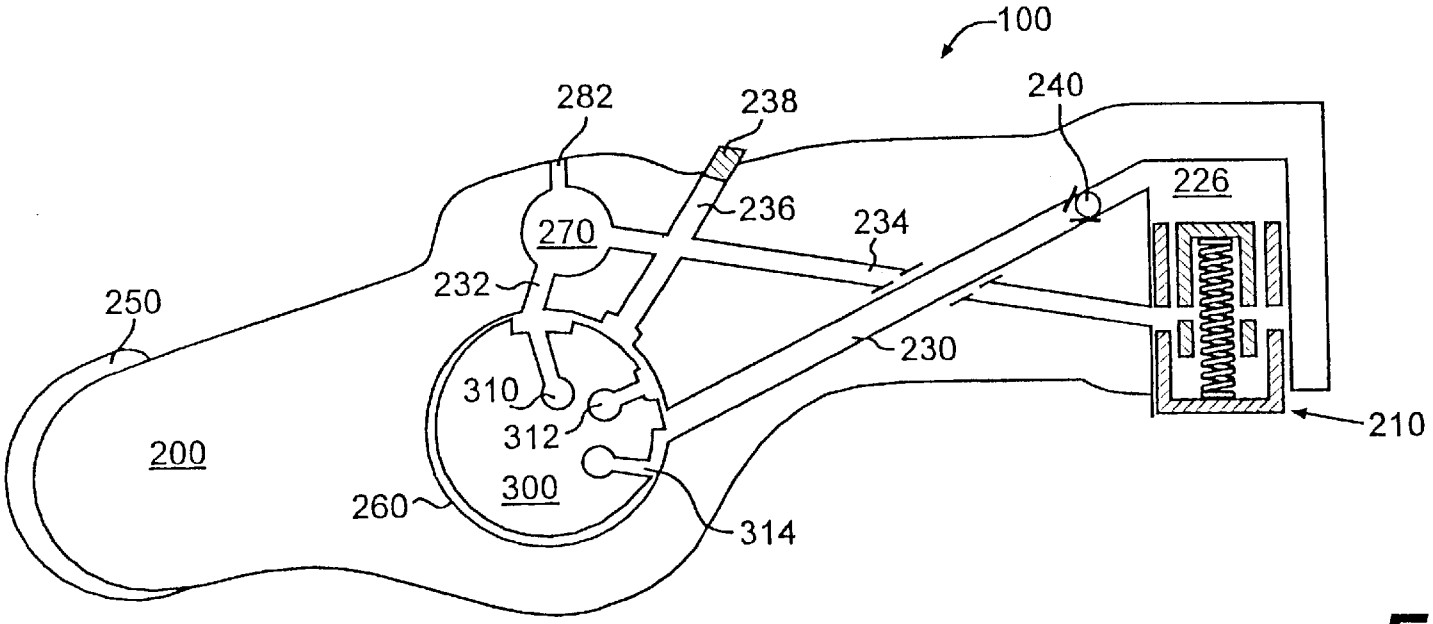
Figure 4:
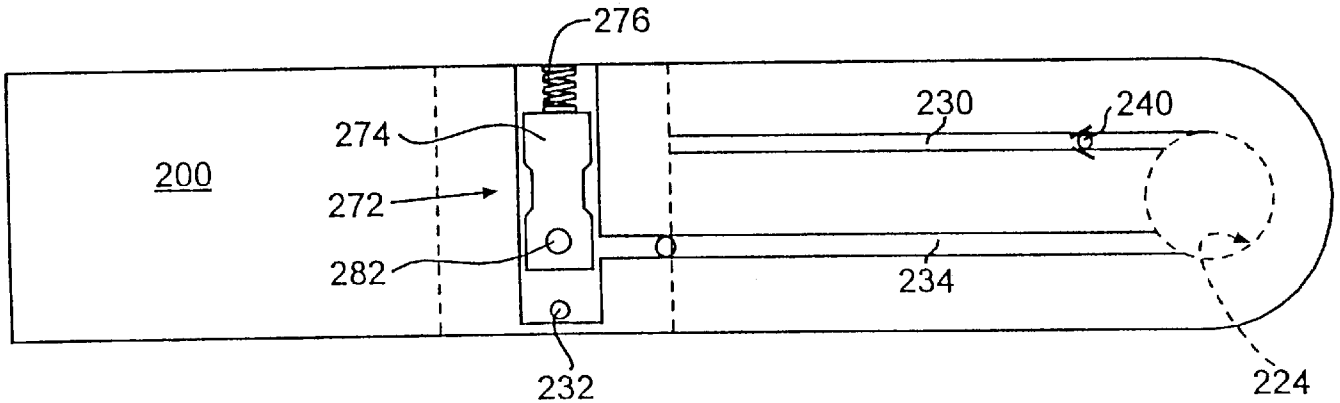

With reference to FIGS. 3 and 4, in which like reference numerals refer to like elements, the configuration of the system 100 is varied in an alternative embodiment of the invention as follows. An air vent passage 282 is provided between the control valve bore 270 and the atmosphere. Furthermore, the check valve and hydraulic passage arrangement is eliminated from the spool 274. Hydraulic fluid is supplied to the tappet 210 as the result of leakage past the spool 274 when the control valve 272 is in a "brake on" position, as shown in FIG. 4. In other respects, the system 100 shown in FIGS. 3 and 4 operates in substantially the same way as the system 100 shown in FIGS. 1 and 2.

Figure 5:
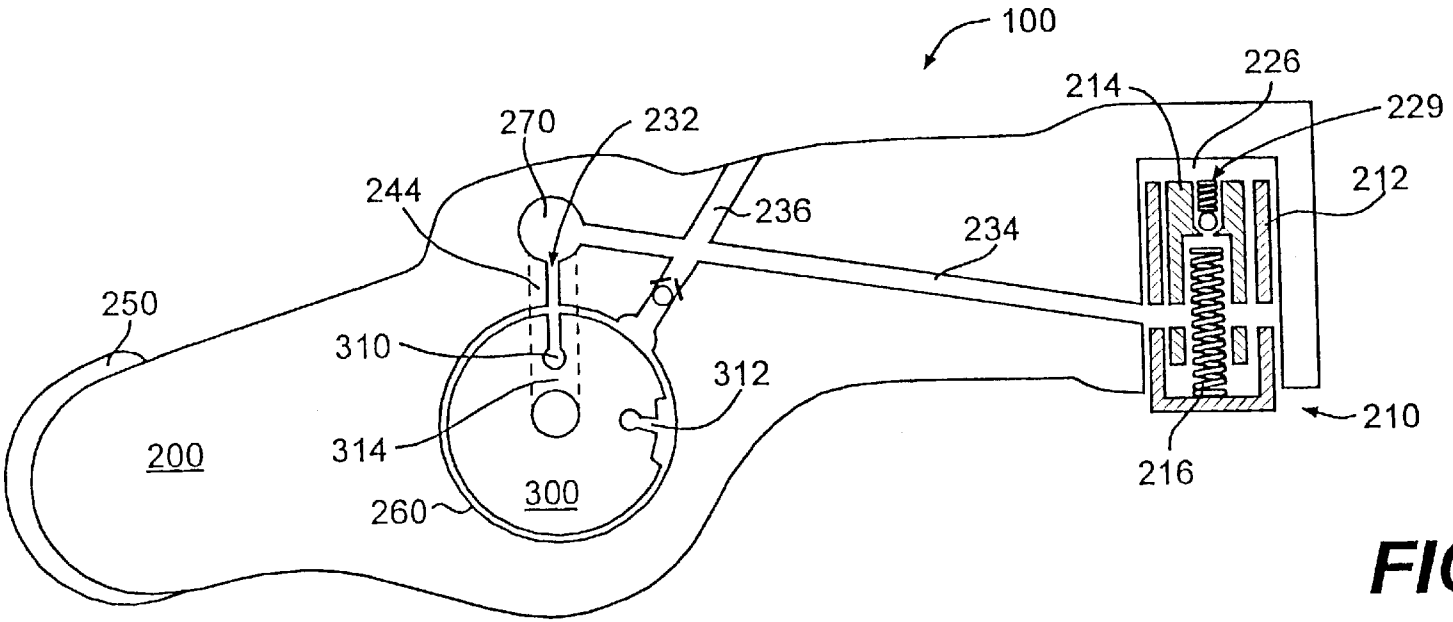
Figure 6:
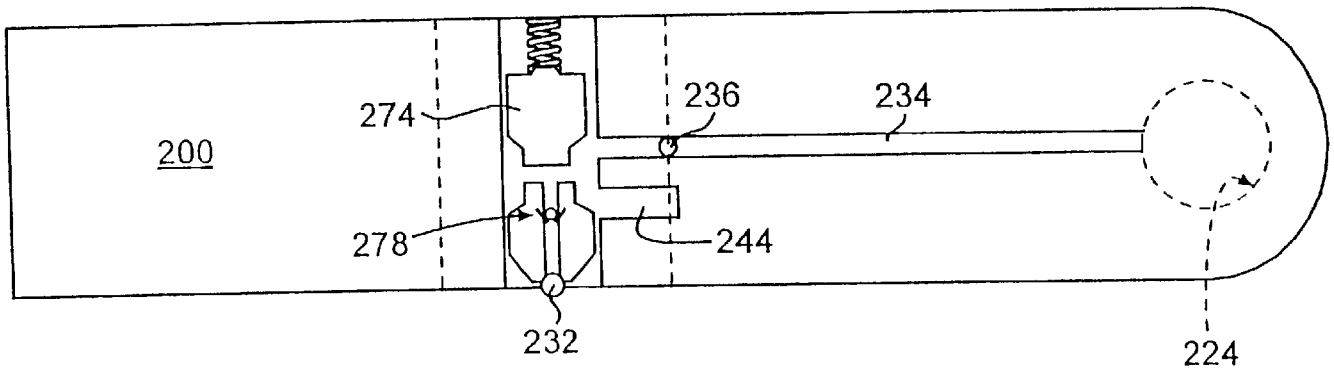

With reference to FIGS. 5 and 6, in which like reference numerals refer to like elements, the configuration of the system 100 is varied in another alternative embodiment of the invention as follows. The tappet 210 is provided with a check valve 229. Lash adjustment of the tappet 210 is achieved by the flow of hydraulic fluid past the check valve 229 into the upper hydraulic chamber 226. The addition of the check valve 229 eliminates the need for a first hydraulic passage and a lash passage (shown in FIG. 1).

The hydraulic fluid used to accomplish lash adjustment is provided from the lash passage 314 to the fifth hydraulic passage 244. The fifth hydraulic passage 244 provides hydraulic communication between the central bore 260 and the control valve bore 270. During positive power operation, the spool 274 permits the flow of hydraulic fluid from the fifth hydraulic passage 244 to the third hydraulic passage 234 for lash adjustment. During engine braking operation, the spool 274 blocks the flow of hydraulic fluid from the fifth hydraulic passage 244, but permits the flow of hydraulic fluid through the internal hydraulic passage and check valve arrangement 278 for lash adjustment.

Figure 7:
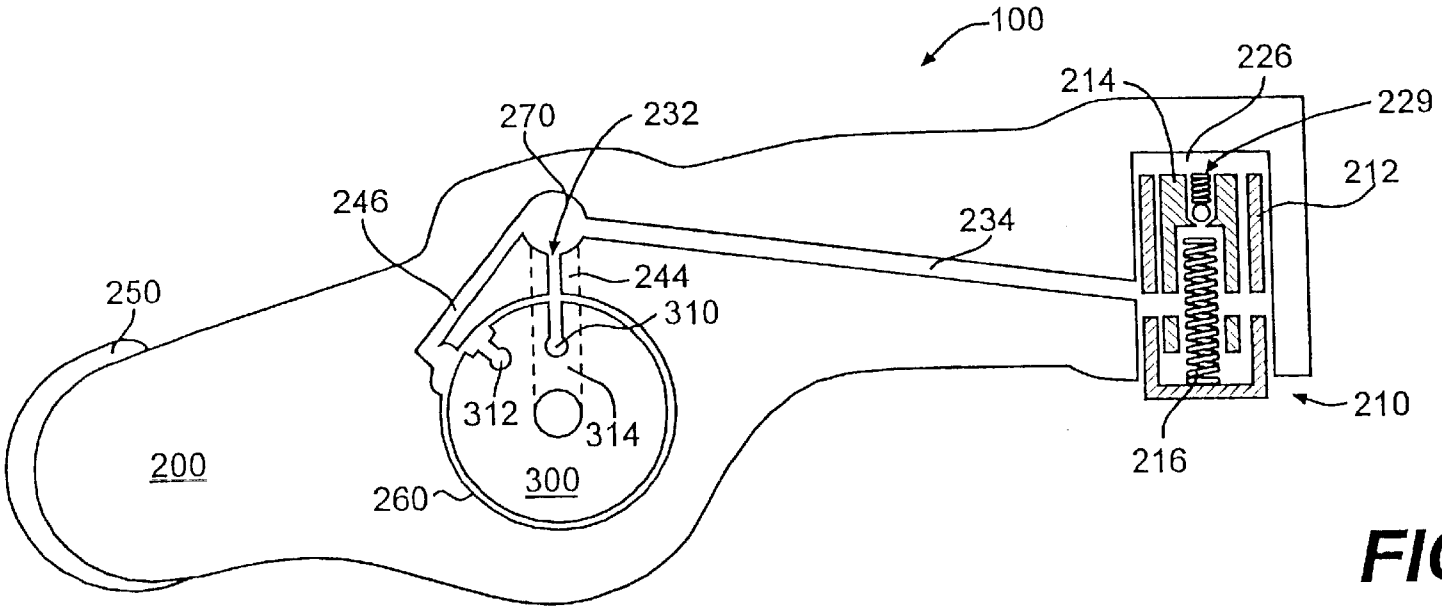
Figure 8:
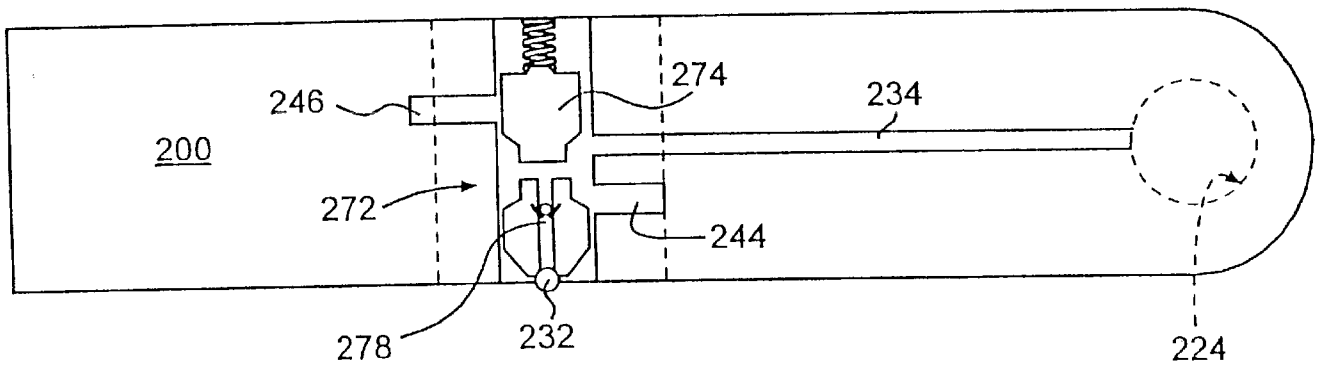

With reference to FIGS. 7 and 8, in which like reference numerals refer to like elements, the configuration of the system 100 is varied from that shown in FIGS. 5 and 6, in another alternative embodiment of the invention as follows. A sixth hydraulic passage 246 in the rocker arm 200 provides selective hydraulic communication between the central bore 260 and the control valve bore 270. During positive power operation, the control valve 272 blocks the sixth hydraulic passage 246 from communicating with the control valve bore 270. The hydraulic fluid required for lash adjustment is provided from the fifth hydraulic passage 244 during positive power.

During engine braking, the spool 274 blocks the fifth hydraulic passage 244, and places the sixth hydraulic passage 246 in communication with the third hydraulic passage 234. The hydraulic fluid needed for lash adjustment is supplied through the internal hydraulic passage and check valve arrangement 278. Rotation of the rocker arm 200 for the main exhaust event results in hydraulic communication between the sixth hydraulic passage 246 and the relief passage 312.

Figure 9:
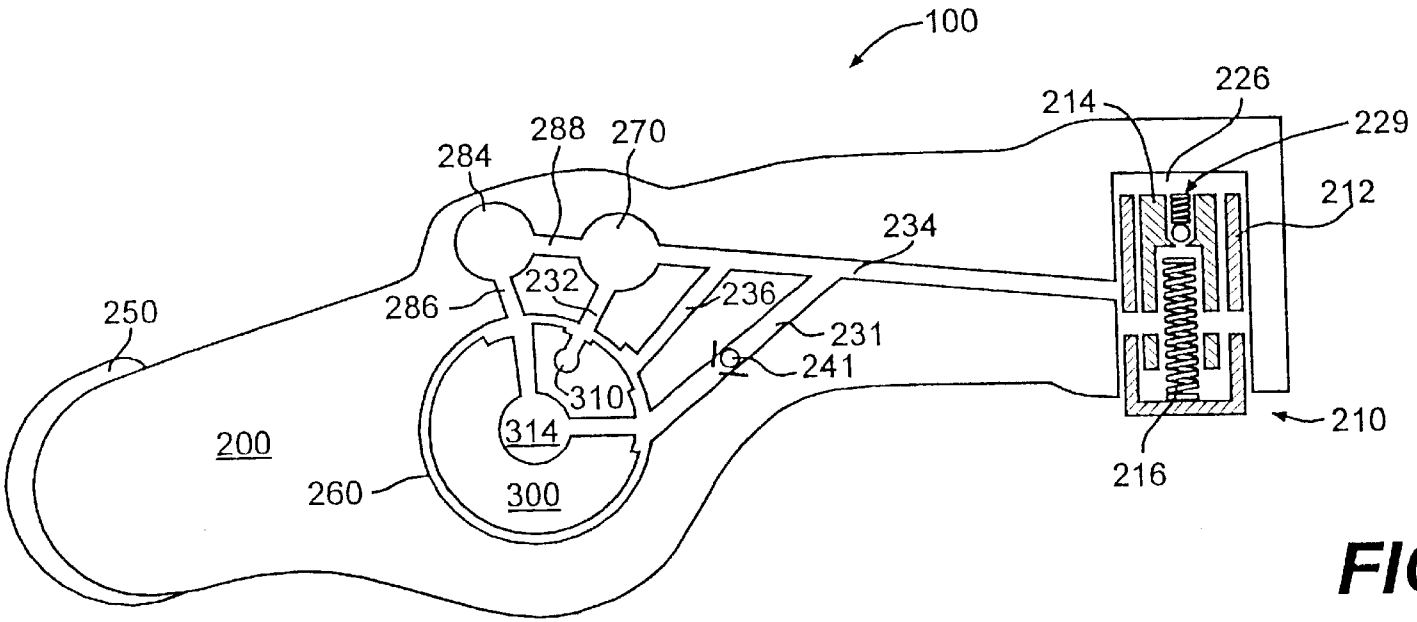
Figure 10:
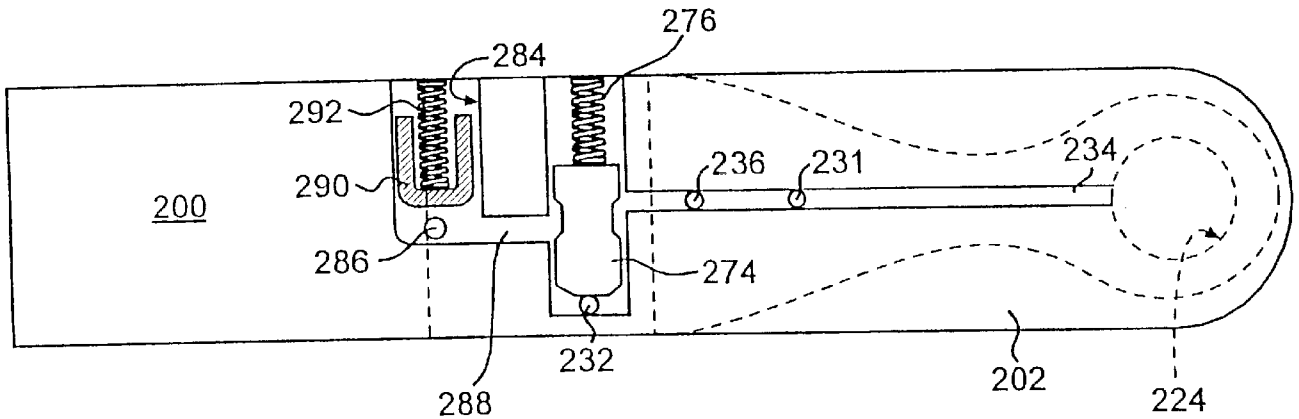

With reference to FIGS. 9 and 10, in which like reference numerals refer to like elements, the configuration of the system 100 is varied from that shown in FIGS. 1 and 2 in another embodiment of the invention as follows. The arrangement of the tappet 210 is the same as that shown in FIGS. 5–8. A seventh hydraulic passage 231 is provided between the central bore 260 and the third hydraulic passage 234. A check valve 241 is provided in the seventh hydraulic passage 231 to prevent the back flow of hydraulic fluid from the third hydraulic passage 234 to the central bore 260. The seventh hydraulic passage 231 provides hydraulic fluid to the tappet 210 for lash adjustment during positive power and engine braking operation.

An accumulator bore 284 is provided in the rocker arm 200. An eighth hydraulic passage 286 provides hydraulic communication between the accumulator bore 284 and the central bore 260. A ninth hydraulic passage 288 provides hydraulic communication between the accumulator bore 284 and the control valve bore 270. An accumulator piston 290 is biased by a spring 292 towards the end of the accumulator bore 284 that connects with the eighth and ninth hydraulic passages, 286 and 288.

During positive power operation, the spool 274 allows hydraulic communication between the third hydraulic passage 234 and ninth hydraulic passage 288. The accumulator piston 290 is free to absorb the flow of hydraulic fluid from the tappet 210, which accordingly, collapses to lose the compression release motion imparted to the rocker arm 200 by the cam 400. During engine braking operation, the spool 274 is moved into a "brake on" position under the influence of hydraulic fluid from the control passage 310. The spool 274 blocks the flow of hydraulic fluid between the third hydraulic passage 234 and the ninth hydraulic passage 288. Release of the hydraulic fluid in the tappet 210 can only occur through the fourth hydraulic passage 236 when the spool 274 is in its "brake on" position. However, the fourth hydraulic passage 236 only communicates with the accumulator piston 290 when the rocker arm 200 pivots during a main exhaust event such that hydraulic communication is established between the fourth hydraulic passage 236 and the lash passage 314. When this communication is established, the hydraulic pressure in the tappet 210 can be relieved through the fourth hydraulic passage, the lash passage 314, and the eighth hydraulic passage 286, into the accumulator bore 284.

With reference to FIG. 10, the phantom lines illustrate that excess material 202 may be removed from the rocker arm 200 to reduce its mass.

Figure 11:
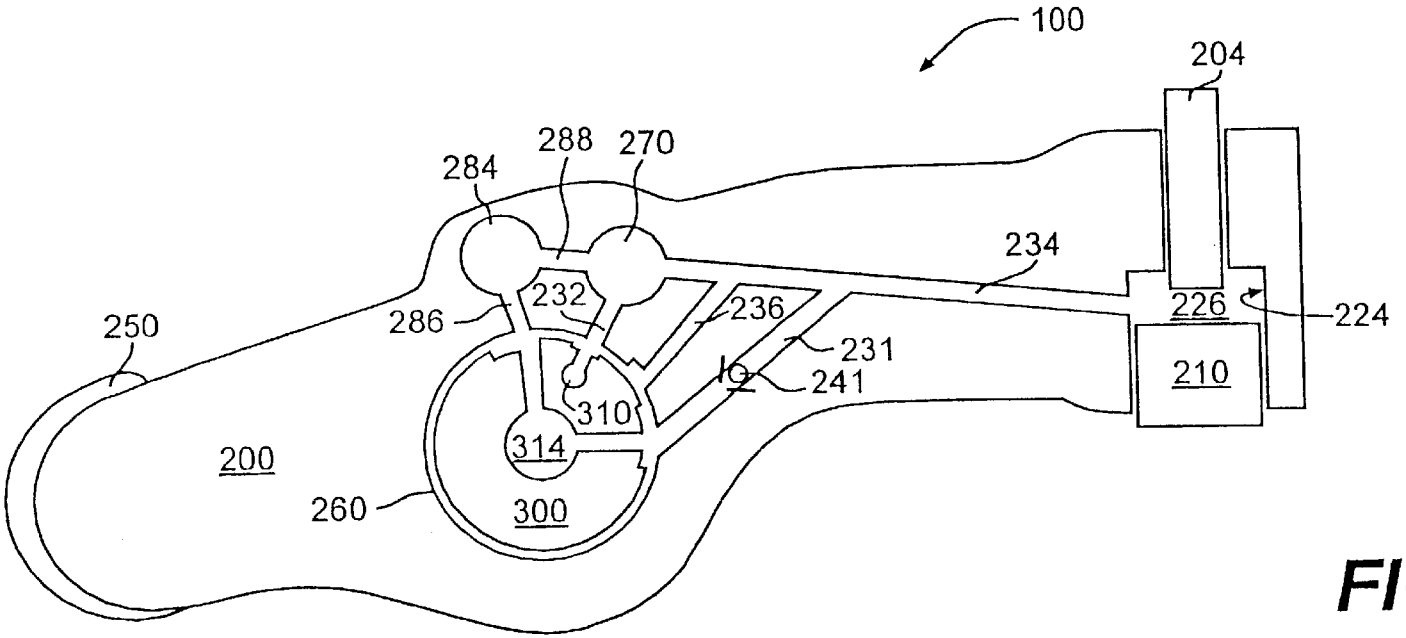
Figure 12:
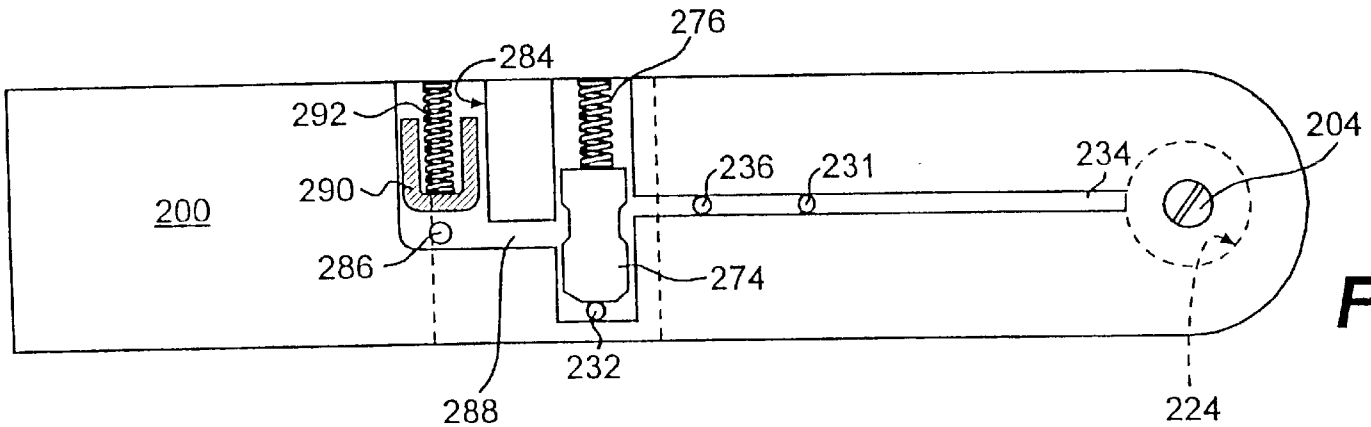

With reference to FIGS. 11 and 12, in which like reference numerals refer to like elements, the configuration of the system 100 is varied from that shown in FIGS. 9 and 10 in another embodiment of the invention as follows. The self-adjusting lash piston 210 shown in FIG. 9 is replaced by a solid piston 210. The lash of the solid piston 210 may be manually adjusted using the screw 204.

Figure 13:
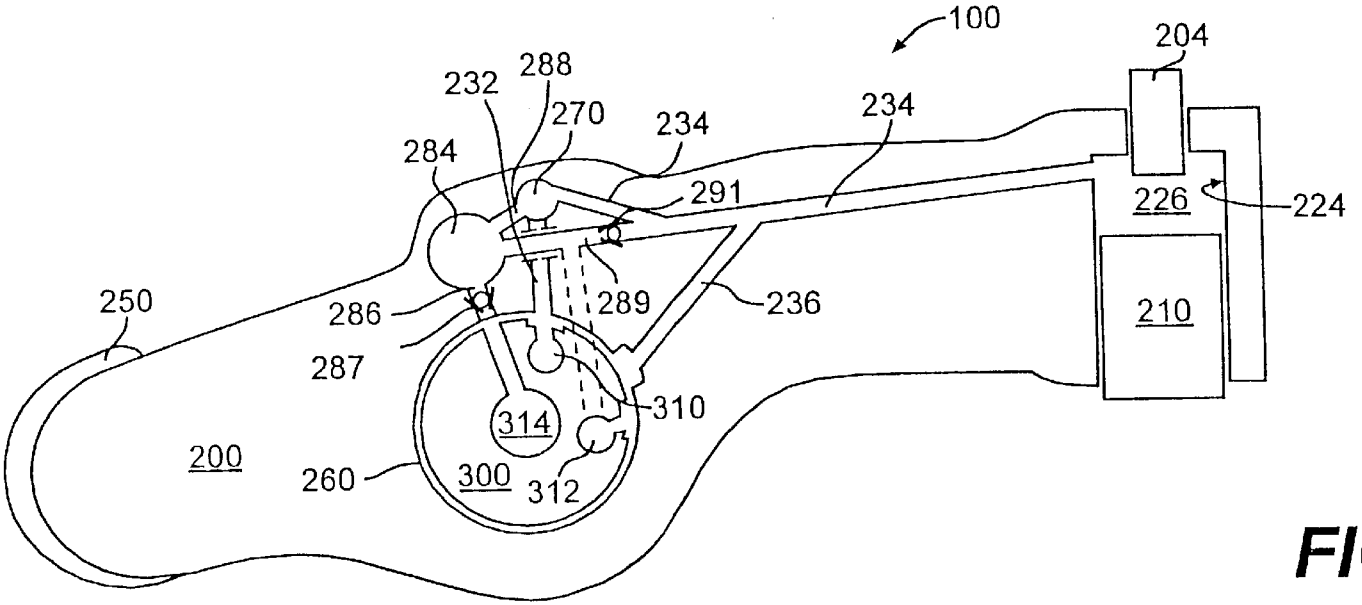
Figure 14:
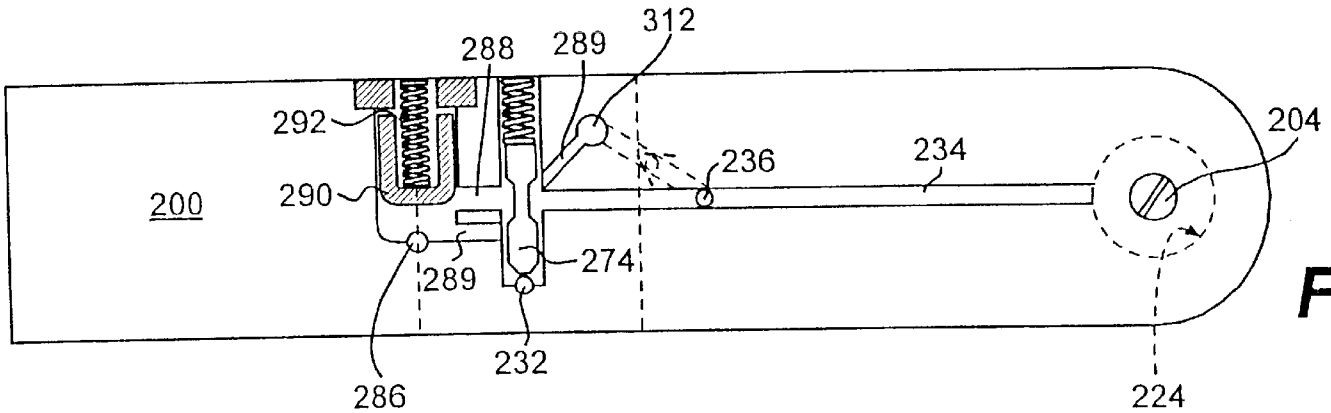

With reference to FIGS. 13 and 14, in which like reference numerals refer to like elements, the configuration of the system 100 is varied from that shown in FIGS. 11 and 12 in another embodiment of the invention as follows. During engine braking operation, hydraulic fluid communication between the upper hydraulic chamber 226 and the accumulator piston bore 284 is established through the combination of the fourth hydraulic passage 236, the relief passage 312, and a tenth hydraulic passage 289. A check valve 287 is disposed in the eighth hydraulic passage 286 to prevent back flow from the accumulator bore 284 to the lash passage 314. A check valve 291 is provided in the tenth hydraulic passage 289 to prevent hydraulic back flow directly from the third hydraulic passage 234 to the accumulator bore 284. During both positive power and engine braking operation, the upper hydraulic chamber 226 is filled with hydraulic fluid from the lash passage 314. This pushes the piston 210 until it contacts the valve creating lashless operation. Supply pressure acting on the piston 210 may not be great enough to compress either the valve springs 500 nor the accumulator springs 292 through the area of the 290 accumulator.

Figure 15:
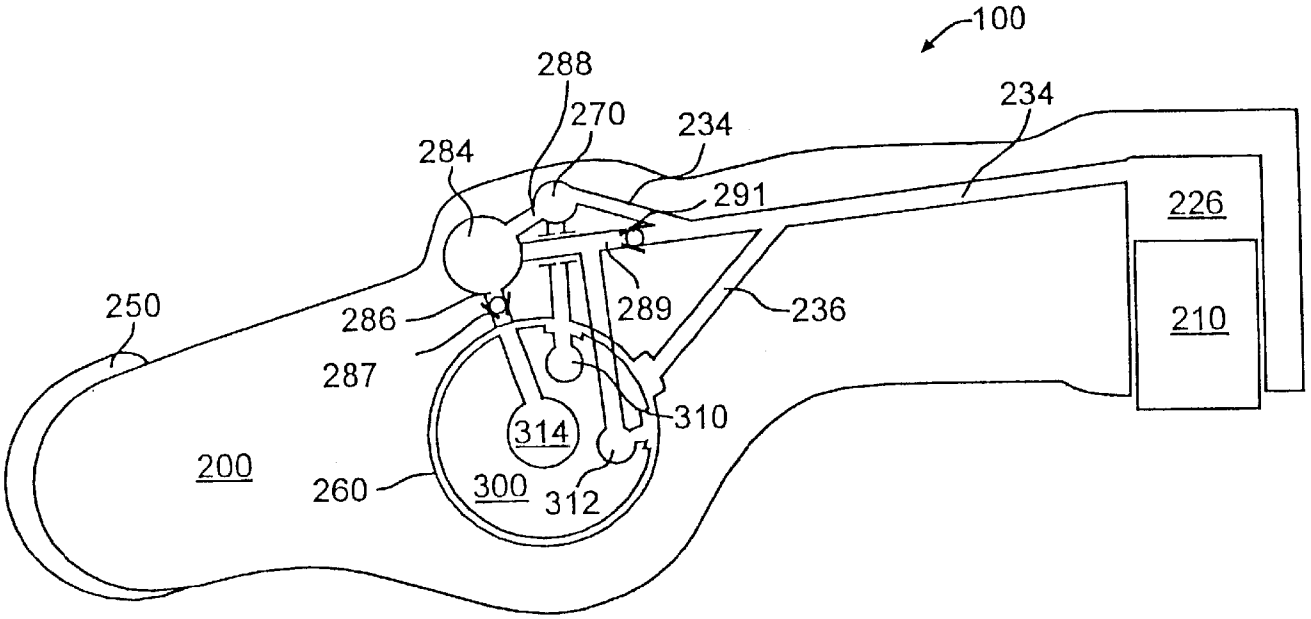
Figure 16:
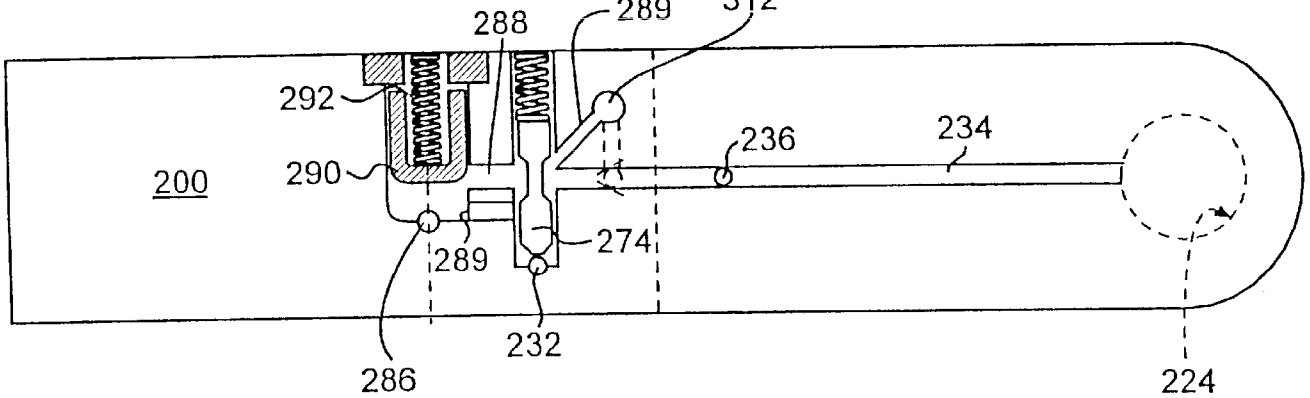

With reference to FIGS. 15 and 16, in which like reference numerals refer to like elements, the configuration of the system 100 is varied from that shown in FIGS. 13 and 14 in another embodiment of the invention by elimination of the lash adjustment screw 204.

Figure 20:
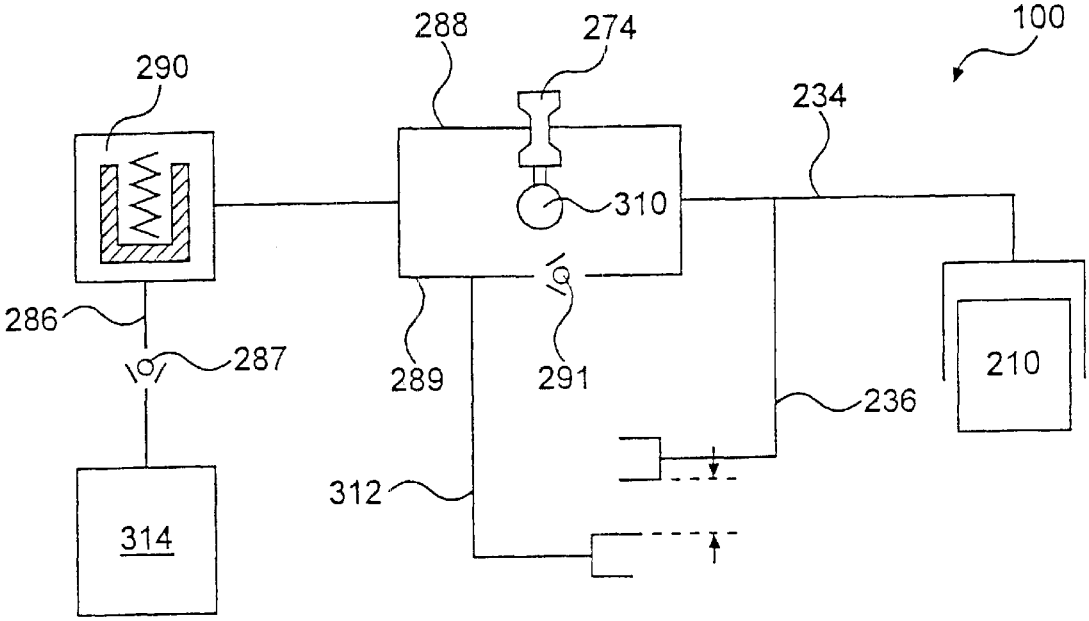
FIGS. 20 and 23 are schematic drawings illustrating fundamental elements of the embodiments of the invention shown in FIGS. 13–16, and FIGS. 21–22, respectively.

FIG. 20, in which like reference numerals refer to like elements, is a schematic representation of the system 100 as shown in FIGS. 13–16.

Figure 17:
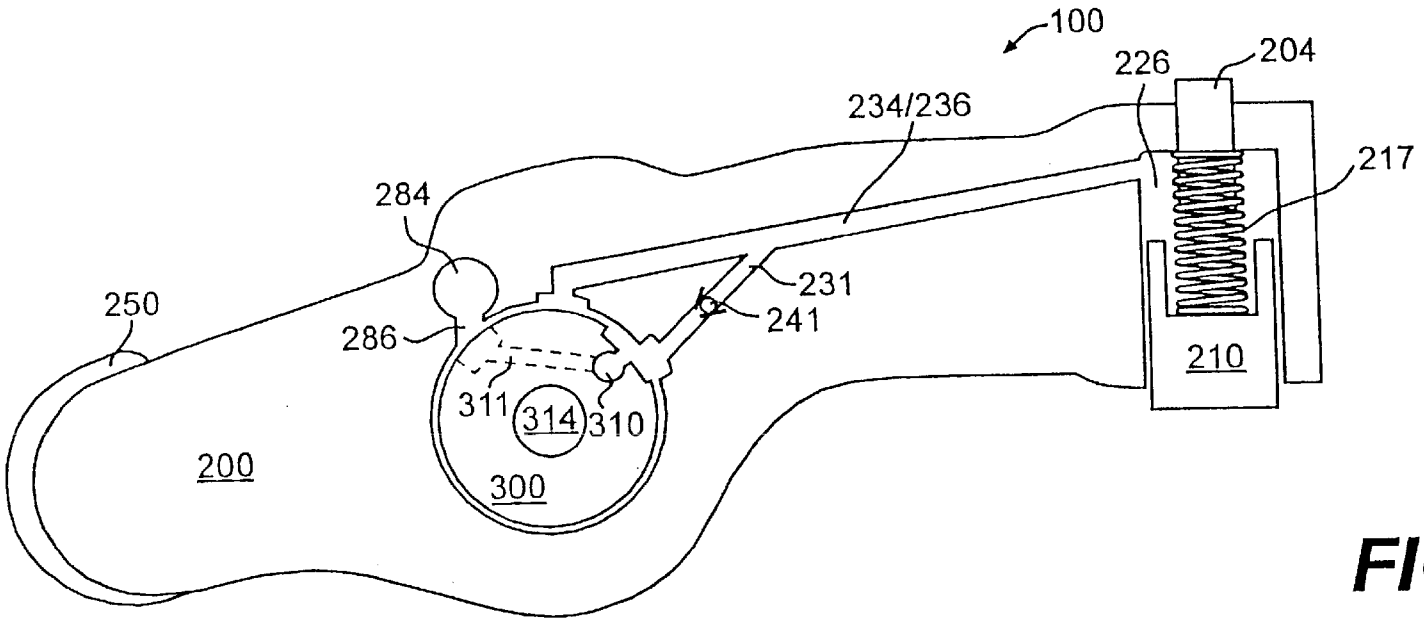
Figure 18:
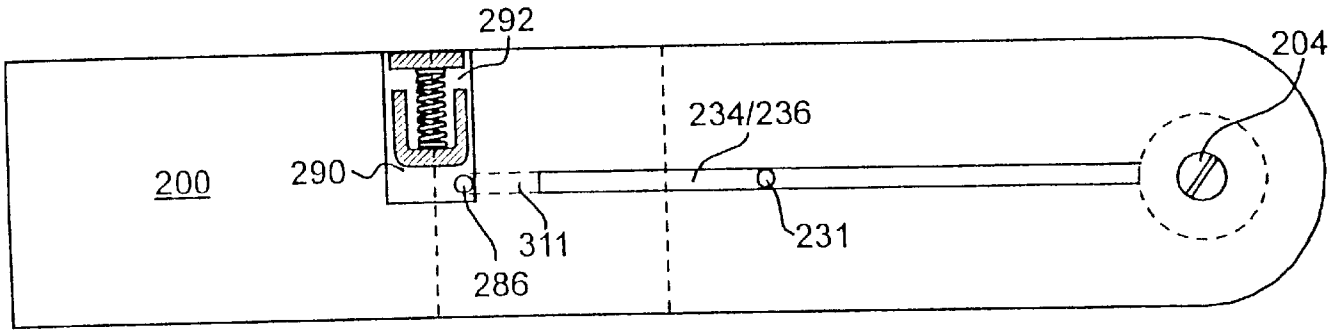

With reference to FIGS. 17 and 18, in which like reference numerals refer to like elements, the configuration of the system 100 is varied from that shown in FIGS. 11 and 12 in another embodiment of the invention as follows. The control valve 272 is eliminated. Lash adjustment of lash piston 210 is made under the influence of the spring 217 and screw 204. During positive power operation, the remote solenoid (not shown) blocks the flow of hydraulic fluid in the control passage 310. Accordingly, during positive power operation, there is no hydraulic pressure in the upper hydraulic chamber 226.

During engine braking operation, low pressure hydraulic fluid is provided in the control passage 310. The low pressure hydraulic fluid fills the upper hydraulic chamber 226 through the seventh hydraulic passage 231 and the third hydraulic passage 234/236. The reverse flow of hydraulic fluid through the seventh hydraulic passage 231 is prevented by the check valve 241. Reverse flow to the control passage 310 from the third hydraulic passage 234 may occur when the rocker arm 200 pivots sufficiently to place the third hydraulic passage 234/236 in hydraulic communication with the control passage 310. The hydraulic pressure released to the control passage 310 during the main exhaust event is transferred via the eleventh passage 311 to the accumulator bore 284.

Figure 19:
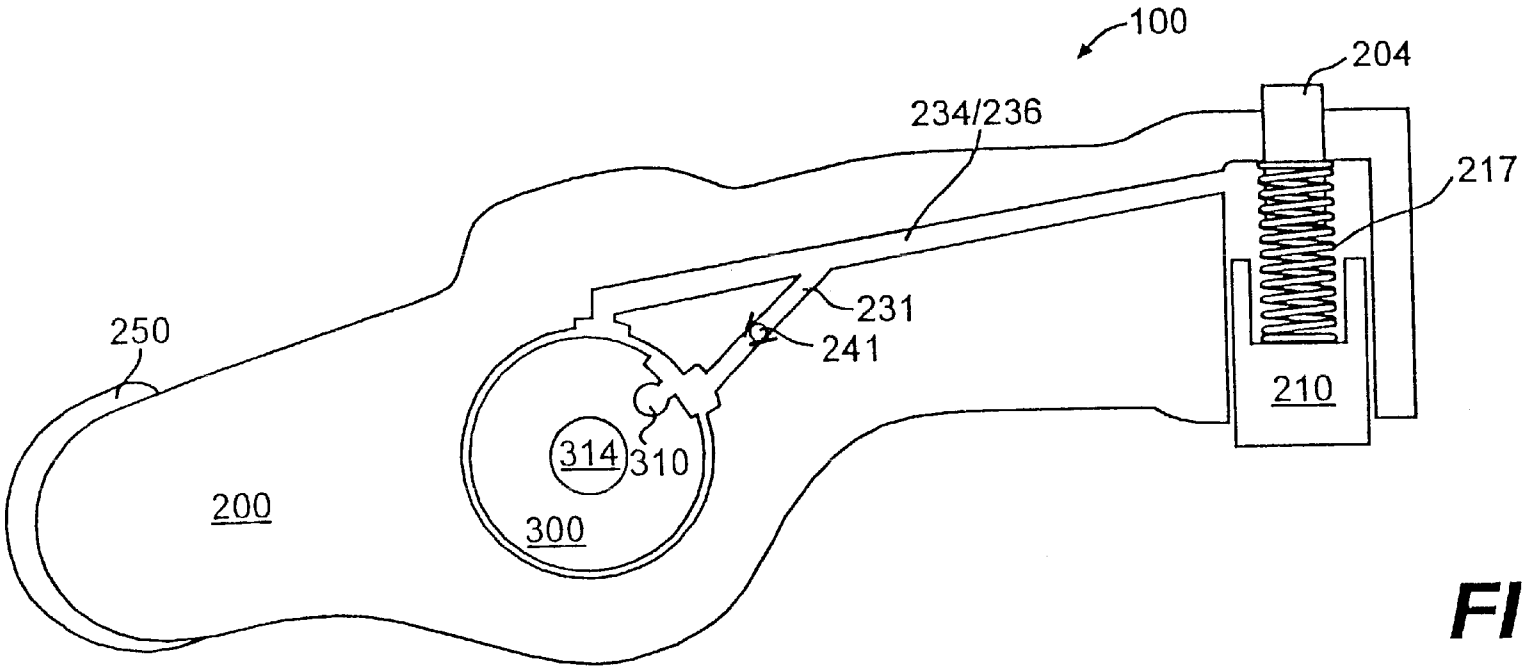

With reference to FIG. 19, in which like reference numerals refer to like elements, the configuration of the system 100 is varied from that shown in FIGS. 17 and 18 in another embodiment of the invention by the placement of the accumulator remote from the rocker arm 200. The accumulator may be placed at the end of the rocker arm shaft, in the rocker arm pedestal, in another rocker arm, or in any other remote location.

Figure 21:
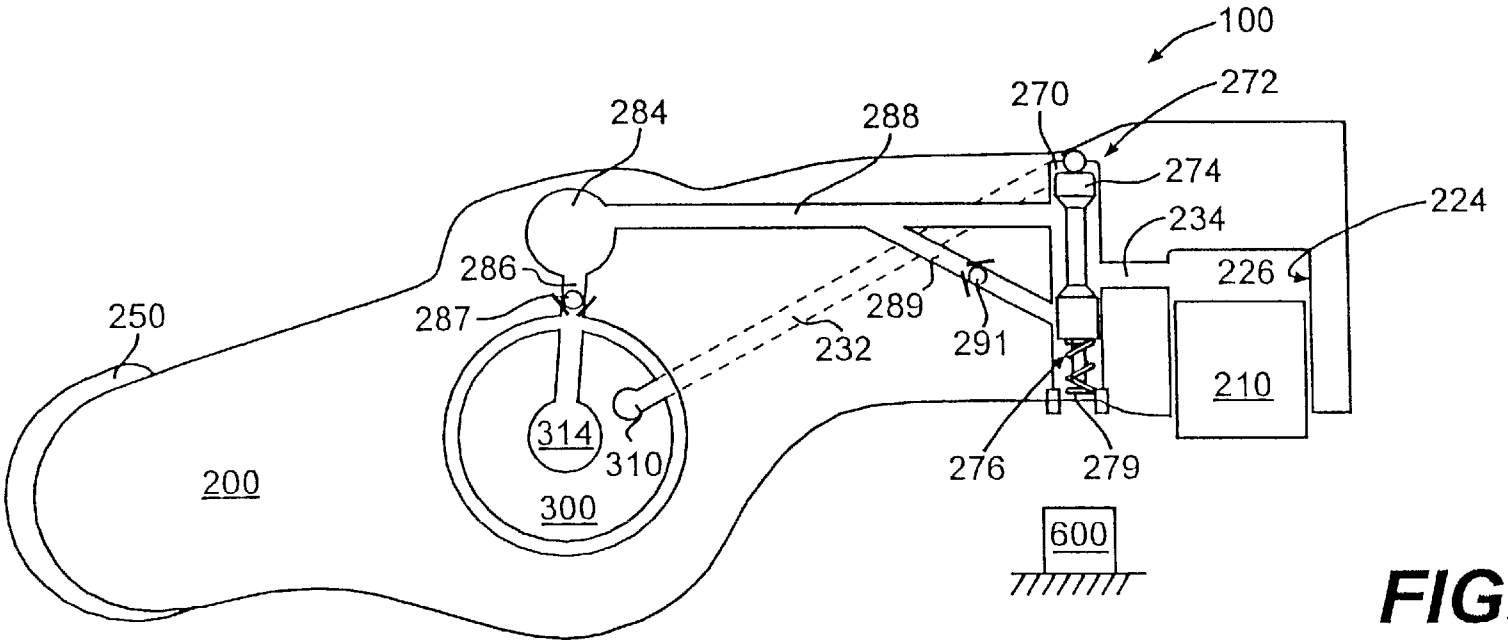
Figure 22:
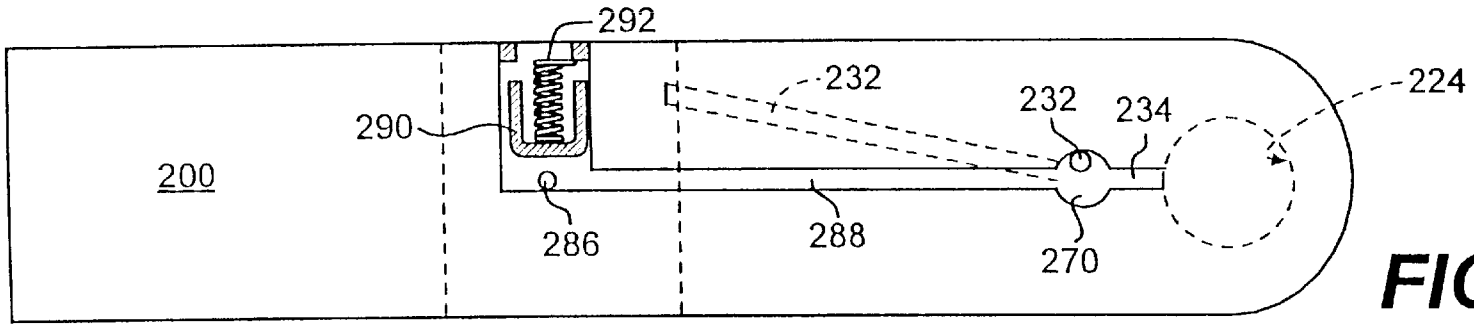

With reference to FIGS. 21 and 22, in which like reference numerals refer to like elements, the configuration of the system 100 is varied from that shown in FIGS. 13 and 14 in another embodiment of the invention as follows. The fourth hydraulic passage 236 is eliminated. The tenth hydraulic passage 289 provides hydraulic communication between the ninth hydraulic passage 288 and the control valve bore 270. The control valve 272 is mounted upright in a distal end of the rocker arm 200. The bottom of the control valve 272 includes an extension 279 which may be used in conjunction with an external stop 600 to trigger the control valve 272 to provide hydraulic communication between the third hydraulic passage 234 and the ninth hydraulic passage 288.

More specifically, the system 100 shown in FIGS. 21–22 operates as follows. During positive power operation, no significant hydraulic pressure is provided in the control passage 310. The absence of significant hydraulic pressure in the control passage 310 permits the spring 276 to bias the spool 274 upward into a position that provides hydraulic communication between the upper hydraulic chamber 226 and the ninth hydraulic passage 288, which in turn communicates with the accumulator piston 290. Hydraulic communication between the upper hydraulic chamber 226 and the accumulator piston 290 permits the lash piston 210 to translate upward in its bore 224 when the rocker arm 200 rotates downward toward a valve stem (not shown).

The upward motion of the lash piston 210 forces hydraulic fluid in the upper chamber 226 and the ninth passage 288 to be absorbed by the accumulator piston 290. The lash piston 210 may translate upward until the accumulator 290 seats against the stop 293. The point at which the lash piston 210 stops its upward movement may be designed to result in the absorption of the all the motion provided to the rocker arm 200 by the engine braking cam lobe. As a result, the lash piston 210 may provide only the main exhaust event associated with the main exhaust cam lobe when there is no hydraulic pressure in the control passage 310.

With continued reference to FIGS. 21 and 22, hydraulic pressure is supplied to the control passage 310 to institute engine braking operation. The presence of hydraulic pressure in the control passage 310 causes the spool 274 to translate downward against the bias of the spring 276. In this position, the spool 274 cuts off communication between the upper hydraulic chamber 226 and the ninth passage 288, and provides hydraulic communication between the upper hydraulic chamber and the tenth hydraulic passage 289. The flow of hydraulic fluid out of the upper hydraulic chamber 226, however, is blocked by the check valve 291 during the initial downward movement of the rocker arm 200 under the influence of the engine braking cam lobe. As a result, the engine braking valve event is transmitted by the rocker arm 200 to the engine valve (not shown).

As the rocker arm 200 continues to move downward under the influence of the main exhaust cam lobe, the spool extension 279 may contact the external stop 600. This contact forces the spool 274 upward until hydraulic communication is reestablished between the upper hydraulic chamber 226 and the accumulator 290 through the ninth hydraulic passage 288. This hydraulic communication allows the upper hydraulic chamber 226 to vent and the lash piston 210 to collapse upward into its bore 224. As a result the motion of the engine valve during the main exhaust event may be reset or clipped, depending upon the point at which the upper hydraulic chamber 226 is vented. As the rocker arm 200 returns to the base circle of the cam 400, the spool 274 will again move downward under the influence of the fluid pressure from the passage 232. This again blocks the communication between 226 and 288. But at this position, the passage 234 is in communication with the accumulator 290 through the check valve 291 and the passages 289 and 288, which allows the fluid to return to the chamber 226. The movement of the spool 274 to reset or clip the engine valve motion may be repeated with each revolution of the cam during engine braking operation.

Figure 23:
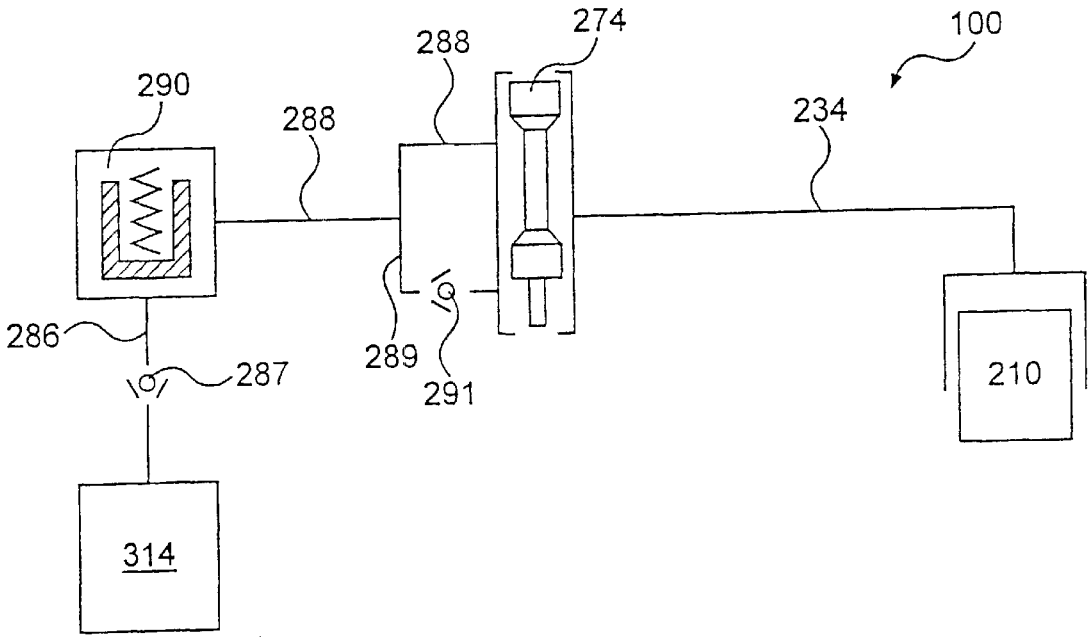

FIG. 23, in which like reference numerals refer to like elements, is a schematic representation of the system 100 as shown in FIGS. 21–22.

Figure 24:
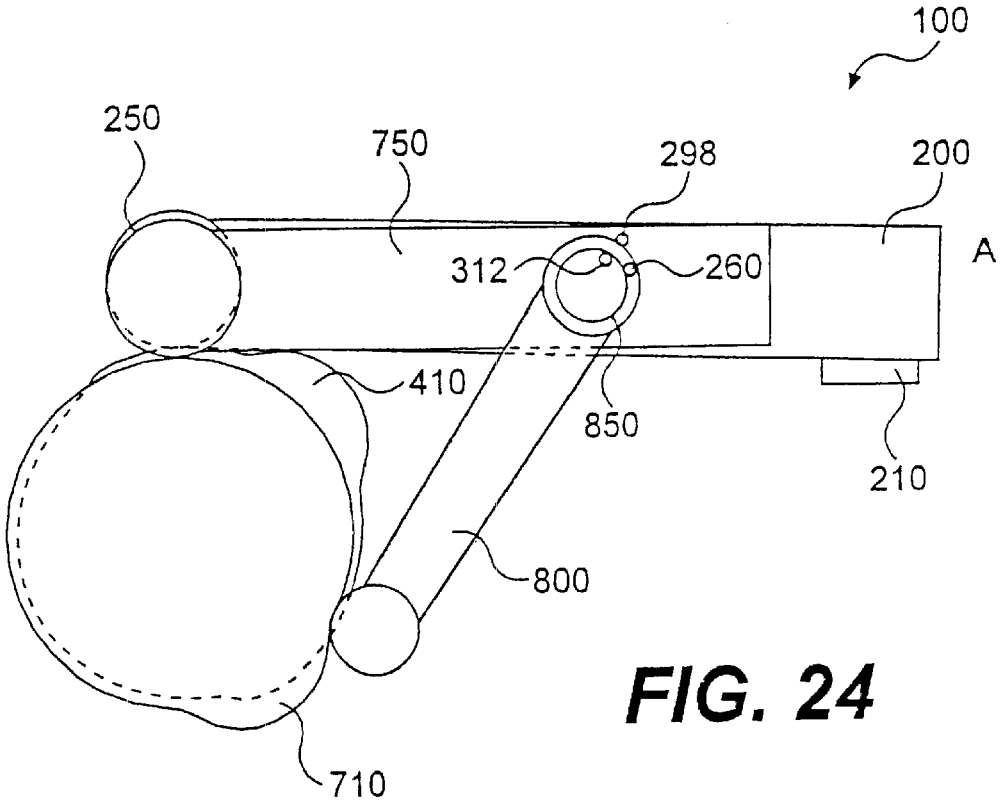
FIGS. 24–29 are cross-sectional views in elevation and top plan of three related alternative embodiments of the invention.
Figure 25:
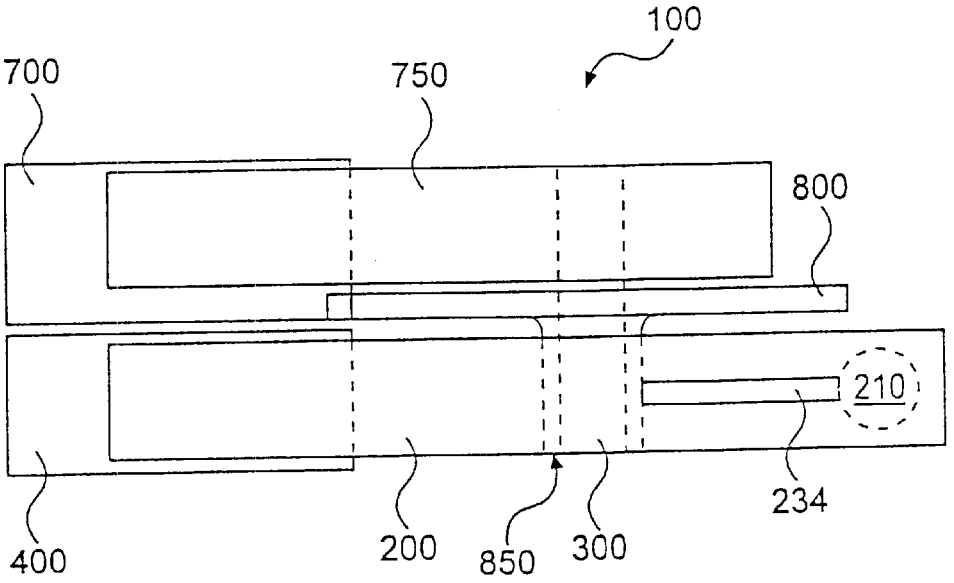

With reference to FIGS. 24 and 25, in which like reference numerals refer to like elements, the configuration of system 100 is varied in yet another embodiment of the invention as follows. The rocker arm shaft 300 pivotally supports an exhaust rocker arm 200 and an intake rocker arm 750. The exhaust rocker arm 200 is driven by an exhaust/compression release cam 400, which includes a main exhaust lobe 410. The intake rocker arm is driven by an intake cam 700, which includes a main intake lobe 710.

A follower arm 800 is disposed on the rocker arm shaft 300 between the intake rocker 750 and the exhaust rocker 200. The follower arm 800 includes a sleeve 850 that extends laterally from the follower arm between the exhaust rocker 200 and the rocker arm shaft 300. The sleeve 850 may form a pivotal seal between the rocker arm shaft 300 and the central bore 260 in the rocker arm 200. The intake cam 700 is slightly wider than normal in order to drive the follower arm 800.

The exhaust rocker 200 includes one or more hydraulic passages (as shown in FIGS. 1–23) that provide hydraulic communication between the lash piston 210 and the central bore 260. Opening 298 is provided at the intersection of the central bore 260 and the hydraulic passage(s) connecting the central bore with the lash piston 210. A relief passage 312 is provided in the rocker arm shaft 300. Sleeve 850 includes a window 852 that provides selective communication between the relief passage 312 and the opening 298. Alignment of the window 852 with the relief passage 312 and the opening 298 may occur when the follower arm 800 is pivoted by the intake cam 700. The length and orientation of the follower arm 800 may be selected to produce alignment of the window 852 with the relief passage 312 and the opening 298 at the point in the engine cycle at which clipping or resetting of the lash piston 210 is desired. Furthermore, the selection of the size and shape of the window 852, the relief passage 312, and the opening 298 may be used to control the clipping or resetting event. As illustrated in the embodiments of the invention shown in FIGS. 1–23, the embodiment of the invention shown in FIGS. 24–25 may include an accumulator to receive the hydraulic fluid released from the lash piston 210 during the clipping/resetting event. The accumulator may be provided in the exhaust rocker arm 200, or at a remote location such as the end of the rocker arm shaft 300. Furthermore, the exhaust rocker arm 200 may also include a control valve, such as those shown in FIGS. 1–23, to place the exhaust rocker arm in a "brake on" mode in the same manner as described for the other embodiments of the invention.

Figure 26:
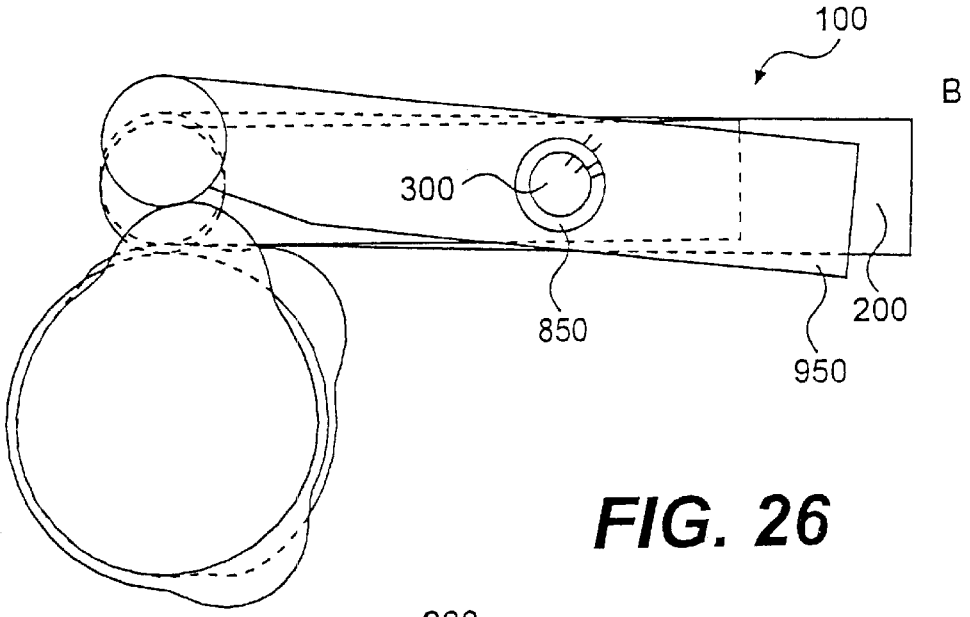
Figure 26A:
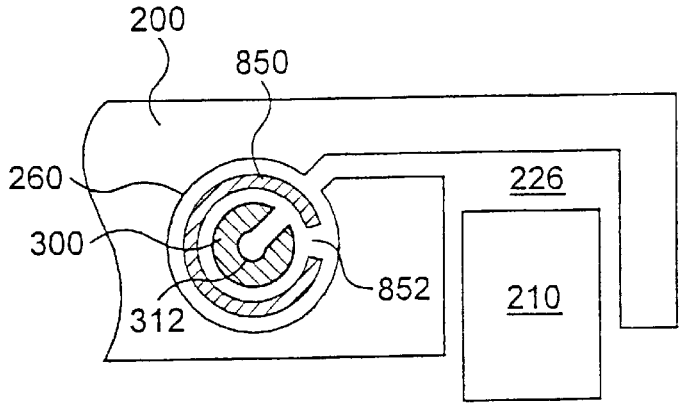
Figure 27:
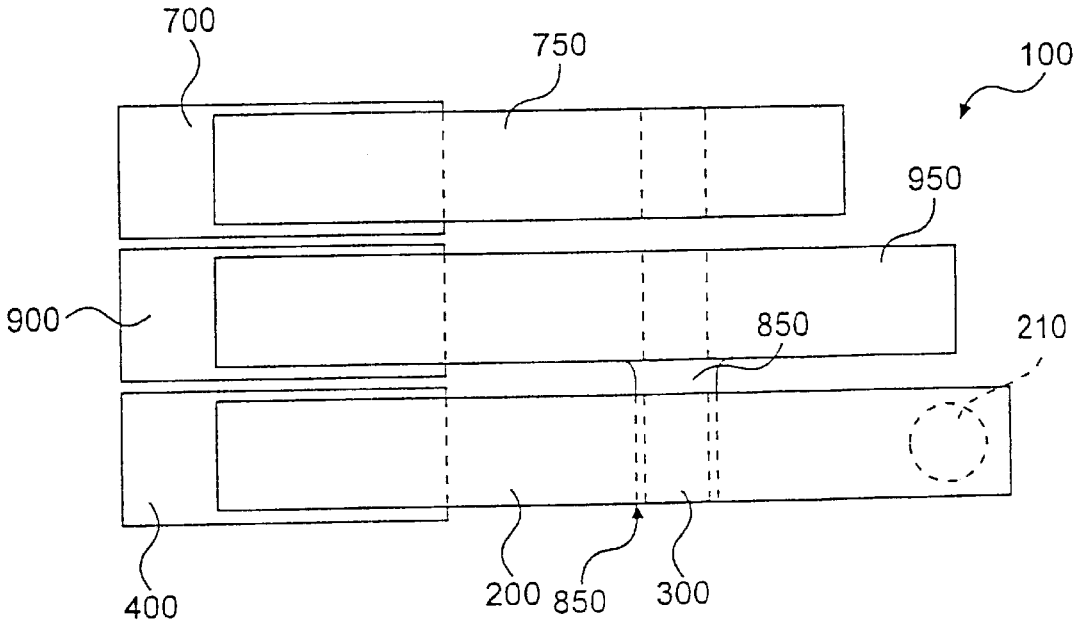

With reference to FIGS. 26, 26A, and 27, in which like reference numerals refer to like elements, the configuration of the system 100 is varied from that shown in FIGS. 24 and 25 in another embodiment of the invention as follows. In addition to the exhaust rocker arm 200 and the intake rocker arm 750, the rocker arm shaft 300 pivotally supports an injector rocker arm 950 between the exhaust and intake rocker arms. The injector rocker arm 950 is driven by an injector cam 900 which includes one or more lobes synchronized to produce a fuel injection event in the engine cylinder serviced by the exhaust, intake, and injector rocker arms. The system 100 shown in FIGS. 26–27 differs from that shown in FIGS. 24–25 primarily by the substitution of the injector rocker arm 950 in the system shown in the later figures for the follower arm 800 shown in the former figures. The variations possible with the system 100 shown in FIGS. 26–27 are comparable to those possible with the system shown in FIGS. 1–25.

Figure 28:
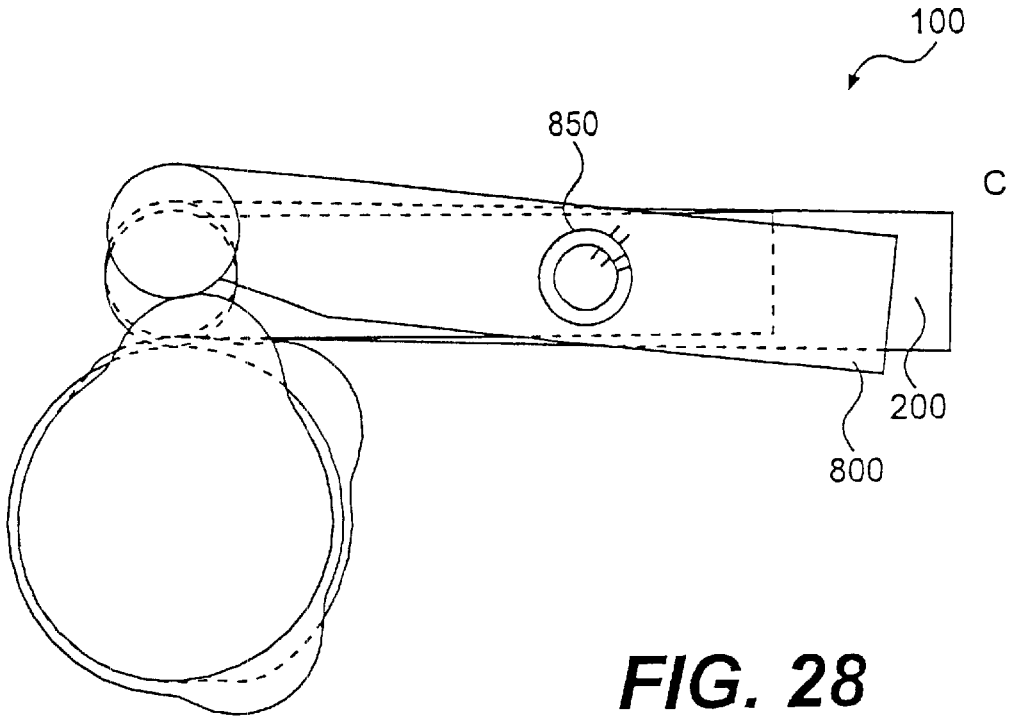
Figure 29:
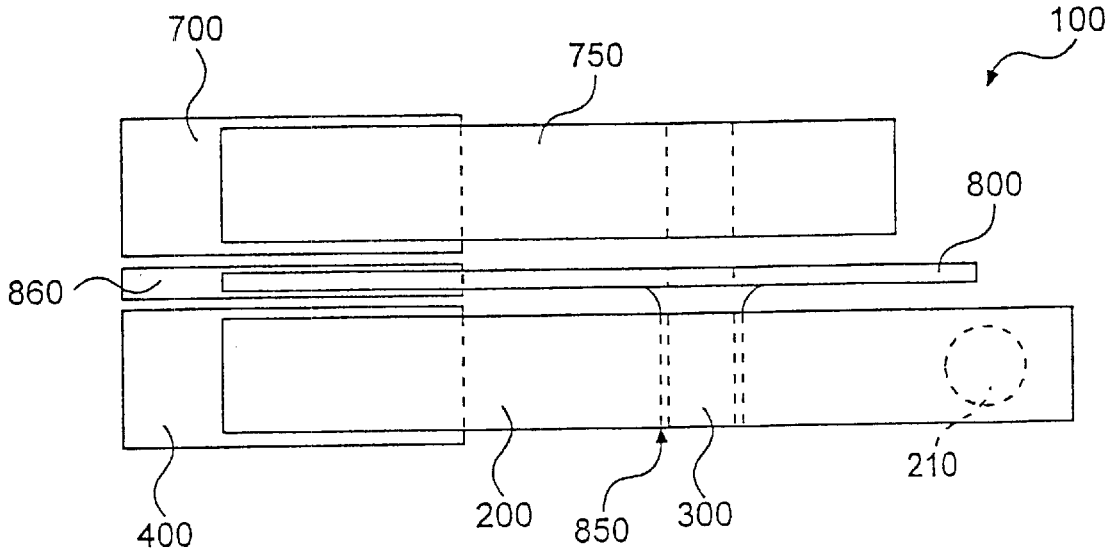

With reference to FIGS. 28 and 29, in which like reference numerals refer to like elements, the configuration of the system 100 is varied from that shown in FIGS. 24 and 25 in another embodiment of the invention as follows. The follower arm 800 is driven by a dedicated follower cam 860 which includes one or more lobes synchronized to produce alignment of the window 852 with the relief passage 312 and the opening 298 at the point in the engine cycle at which clipping or resetting of the lash piston 210 is desired. The system 100 shown in FIGS. 28–29 differs from that shown in FIGS. 24–25 primarily by the substitution of the dedicated follower cam 860 in the system shown in the later figures for the intake cam 700 shown in the former figures. The variations possible with the system 100 shown in FIGS. 28–29 are comparable to those possible with the system shown in FIGS. 1–27.

Figure 30:
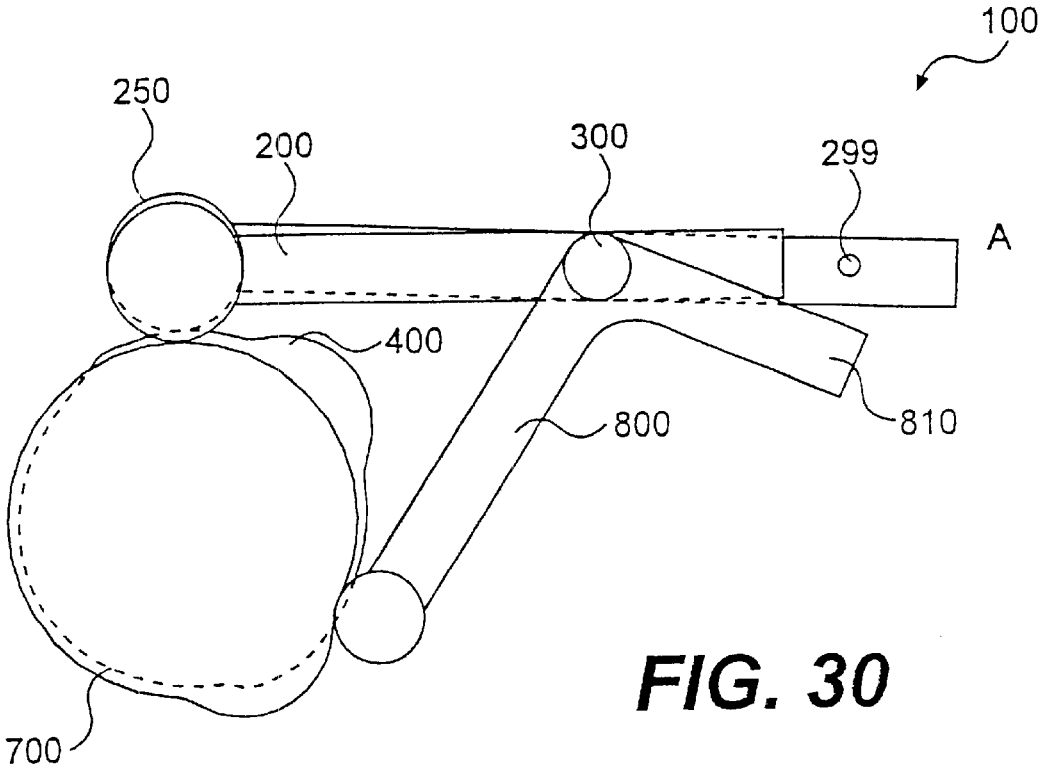
FIGS. 30–33 are cross-sectional views in elevation and top plan of two related alternative embodiments of the invention.
Figure 31:
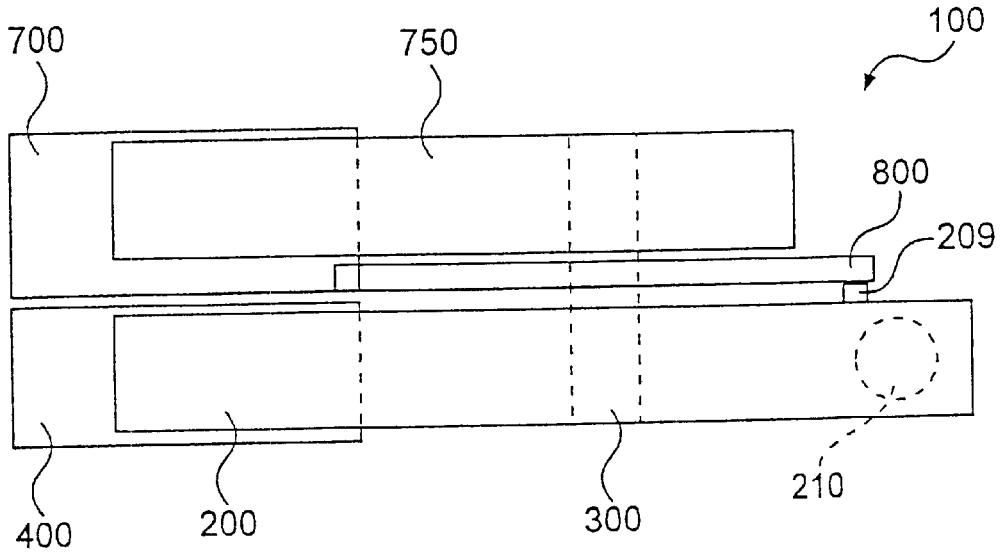

With reference to FIGS. 30 and 31, in which like reference numerals refer to like elements, the configuration of the system 100 is varied from that shown in FIGS. 24 and 25 in another embodiment of the invention as follows. The follower arm 800 includes an extension 810, so that it is L-shaped. The exhaust rocker arm 200 includes a clip/reset actuator 299. The length and shape of the follower arm 800 may be selected to produce contact between the extension 810 and the actuator 299 at the point in the engine cycle at which clipping or resetting of the lash piston 210 is desired. This contact triggers the release of hydraulic fluid from the lash piston 210.

In a variation of the system 100 shown in FIGS. 30 and 31, the length and shape of the follower arm 800 may be selected to remove contact between the extension 810 and the actuator 299 at the point in the engine cycle at which clipping or resetting of the lash piston 210 is desired. This removal of contact triggers the release of hydraulic fluid from the lash piston 210. The variations possible with the system 100 shown in FIGS. 30–31 are comparable to those possible with the system shown in FIGS. 1–29.

Figure 32:
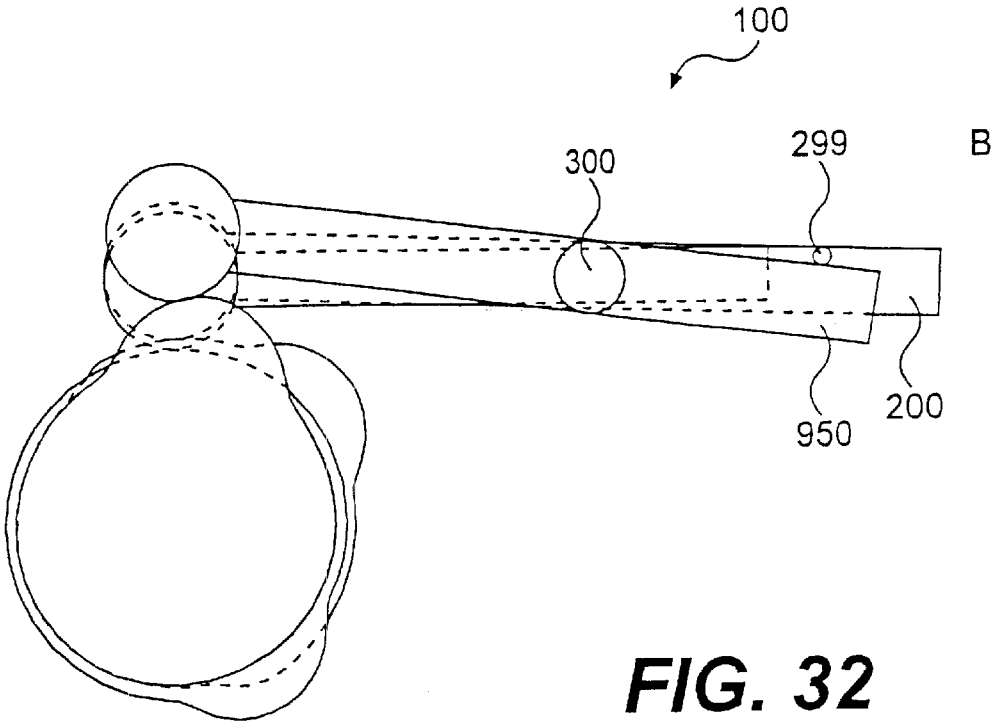
Figure 33:
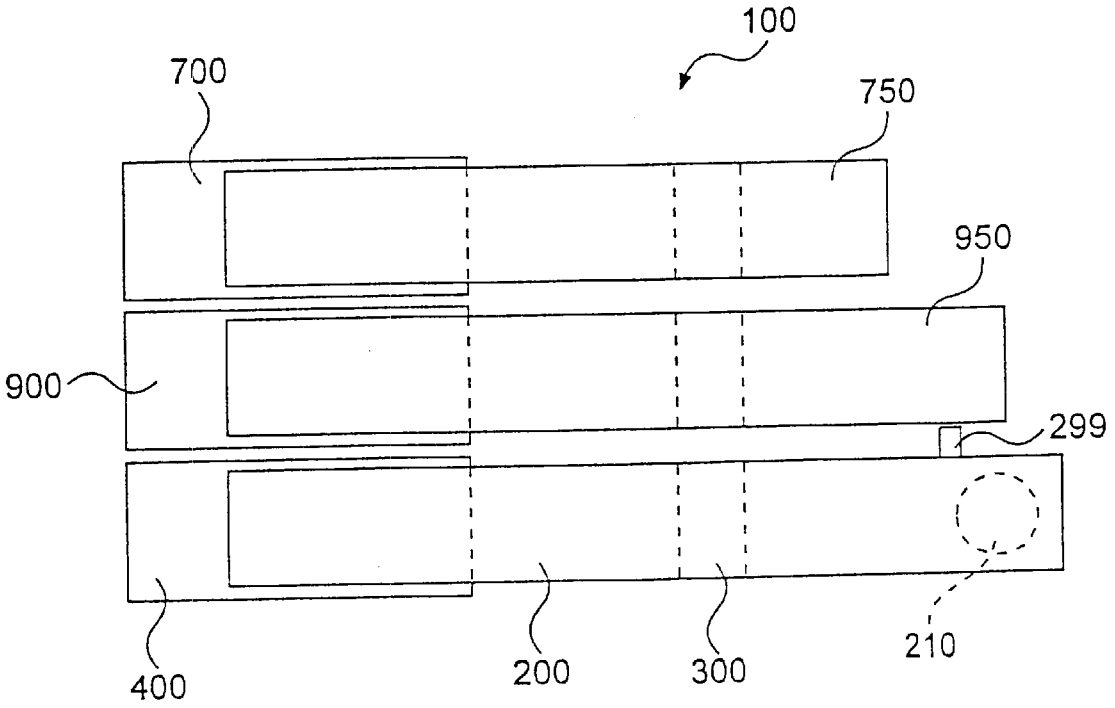

With reference to FIGS. 32 and 33, in which like reference numerals refer to like elements, the configuration of the system 100 is varied from that shown in FIGS. 30 and 31 in another embodiment of the invention as follows. In addition to the exhaust rocker arm 200 and the intake rocker arm 750, the rocker arm shaft 300 pivotally supports an injector rocker arm 950 between the exhaust and intake rocker arms. The injector rocker arm 950 is driven by an injector cam 900 which includes one or more lobes synchronized to produce a fuel injection event in the engine cylinder serviced by the exhaust, intake, and injector rocker arms. The system 100 shown in FIGS. 32–33 differs from that shown in FIGS. 30–31 primarily by the substitution of the injector rocker arm 950 in the system shown in the later figures for the follower arm 800 shown in the former figures. The contact (or removal of contact) used to trigger the clip or reset event occurs between the injector rocker arm 950 and the actuator 299, rather than between a follower arm and the actuator.

Figure 34:
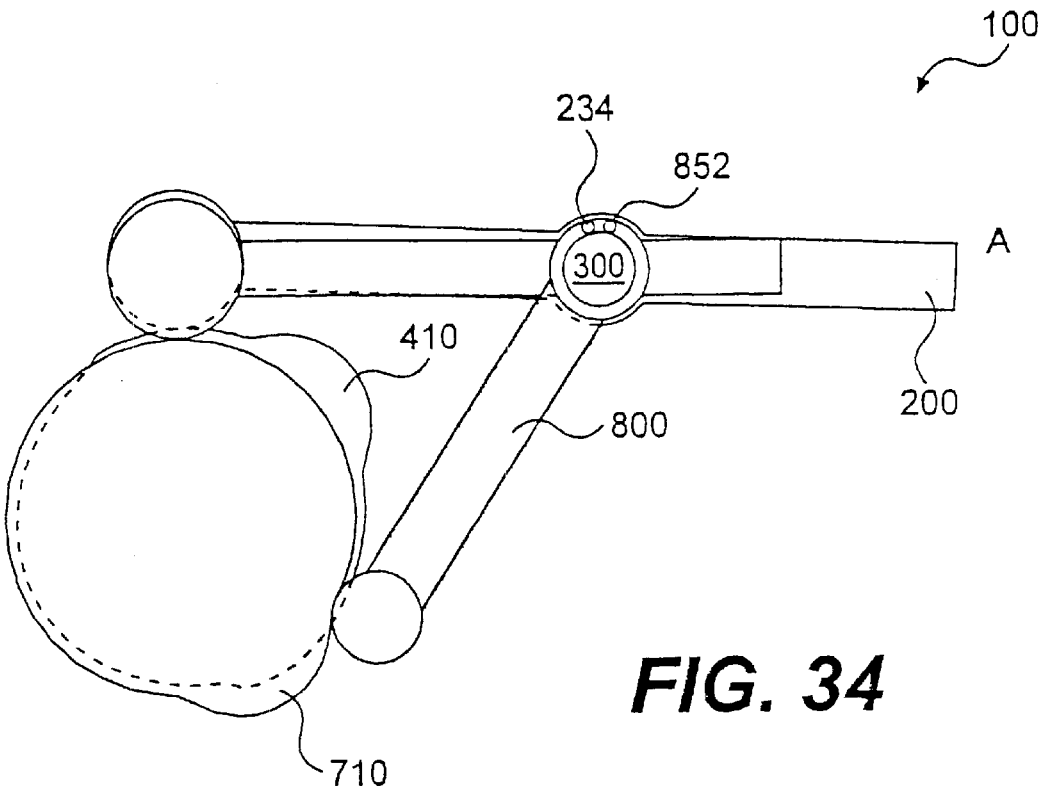
FIGS. 34–37 are cross-sectional views in elevation and top plan of two related alternative embodiments of the invention.
Figure 35:
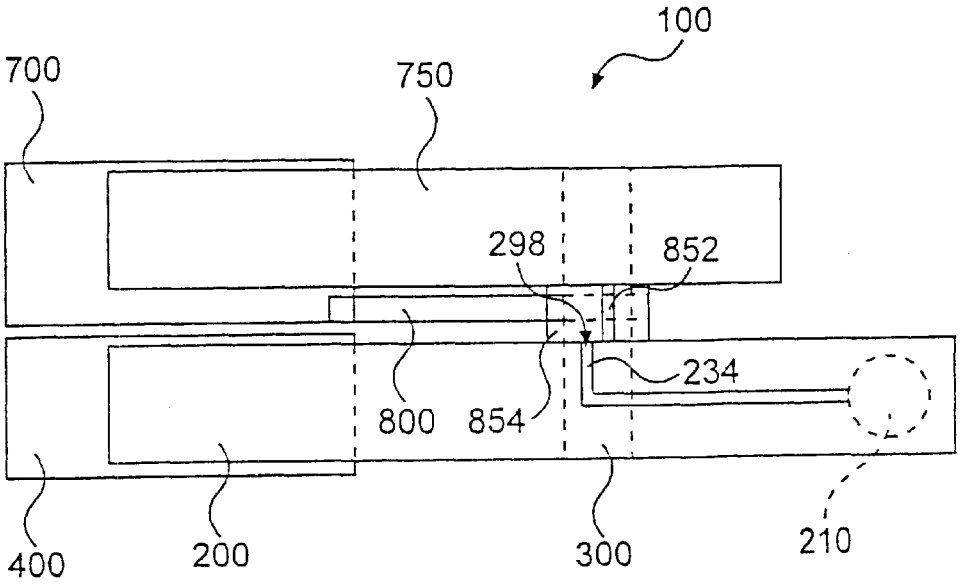

With reference to FIGS. 34 and 35, in which like reference numerals refer to like elements, the configuration of system 100 is varied in still another embodiment of the invention as follows. The rocker arm shaft 300 pivotally supports an exhaust rocker arm 200 and an intake rocker arm 750. The exhaust rocker arm 200 is driven by an exhaust/compression release cam 400, which includes a main exhaust lobe 410. The intake rocker arm is driven by an intake cam 700, which includes a main intake lobe 710.

A follower arm 800 is disposed on the rocker arm shaft 300 between the intake rocker 750 and the exhaust rocker 200. The follower arm 800 includes a ring 854 that forms a pivotal seal between the exhaust rocker arm 200 and the intake rocker arm 750. The follower arm 800 may be driven by the intake rocker cam 700.

The exhaust rocker 200 includes one or more hydraulic passages 234 that provide hydraulic communication between the lash piston 210 and the side of the exhaust rocker arm 200 that is sealed against the ring 854. Opening 298 is provided in the exhaust rocker arm 200 at the intersection of the side of the exhaust rocker arm and the ring 854. Ring 854 includes a window passage 852 offset from the opening 298 such that the window passage and the opening are selectively placed in hydraulic communication. Alignment of the window passage 852 with the opening 298 may occur when the follower arm 800 is pivoted by the intake cam 700 in one direction and the exhaust rocker arm 200 is pivoted by the exhaust cam 400 in the opposite direction. Alignment of the window passage 852 and the opening 298 allows the hydraulic fluid in the lash piston 210 to vent to atmosphere or a remotely located accumulator. The length and orientation of the follower arm 800, as well as the size and shape of the window passage 852 and the opening 298, may be selected to produce alignment of the window 852 with the opening 298 at the point in the engine cycle at which clipping or resetting of the lash piston 210 is desired.

Figure 36:
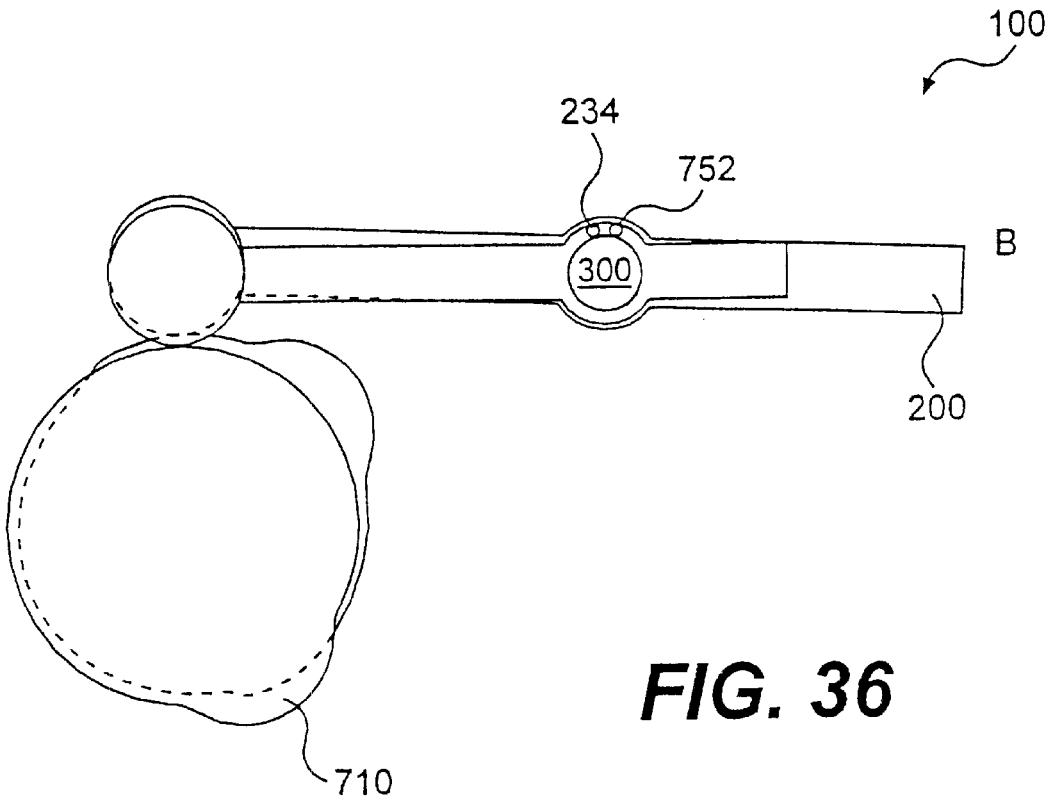
Figure 37:
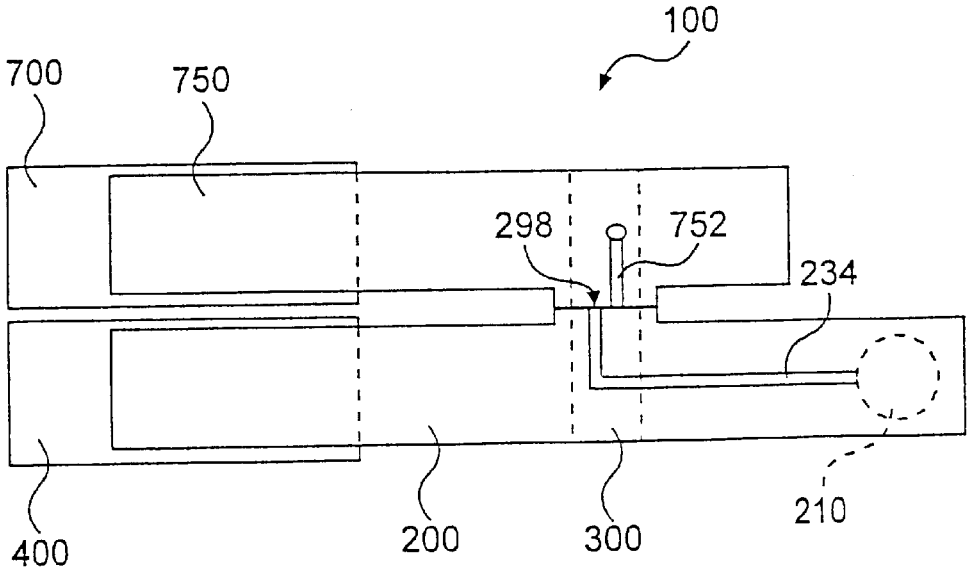

With reference to FIGS. 36 and 37, in which like reference numerals refer to like elements, the configuration of the system 100 is varied from that shown in FIGS. 34 and 35 in another embodiment of the invention as follows. The follower arm 800 is eliminated. A window passage 752 is provided in the intake rocker arm 750 (or alternatively in an injector rocker arm). The exhaust rocker arm 200 and the intake rocker arm 750 each include a boss that forms a pivotal seal with the boss on the other rocker arm. Alignment of the window passage 752 with the opening 298 may occur when the intake rocker arm 750 is pivoted by the intake cam 700 in one direction and the exhaust rocker arm 200 is pivoted by the exhaust cam 400 in the opposite direction. Alignment of the window passage 752 and the opening 298 allows the hydraulic fluid in the lash piston 210 to vent to atmosphere or a remotely located accumulator.

Figure 38:
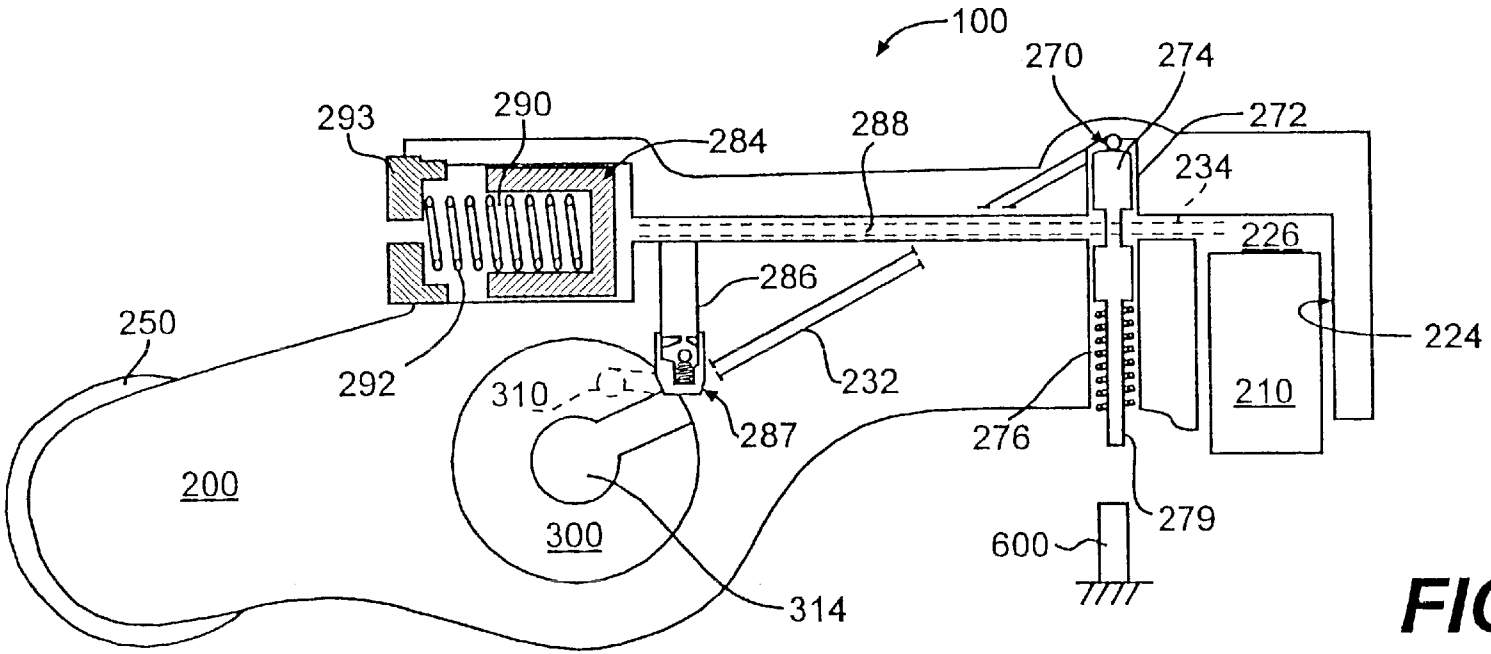
FIGS. 38–40 are cross-sections and a top plan view of another alternative embodiment of the invention.
Figure 39:
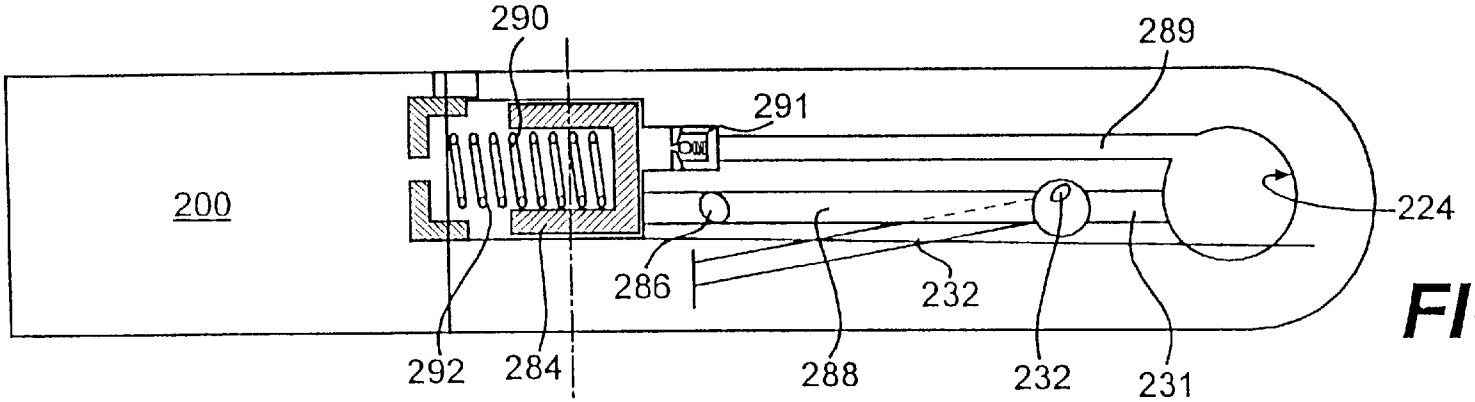
Figure 40:
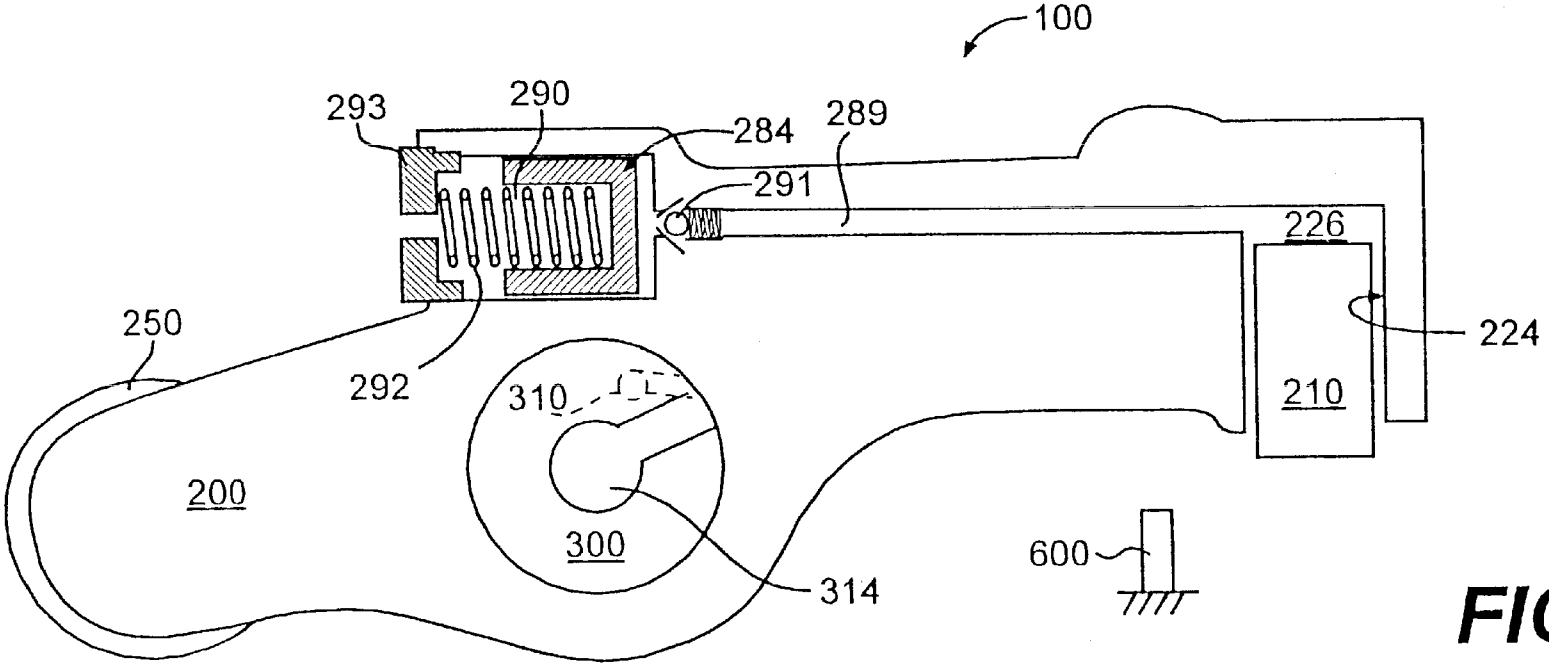

With reference to FIGS. 38–40, where FIG. 38 is a cross-section through passage 288, and FIG. 40 is a cross-section through passage 289, and in which like reference numerals refer to like elements, the configuration of the system 100 is varied from that shown in FIGS. 13 and 14 in another embodiment of the invention as follows. The fourth hydraulic passage 236 is eliminated. The tenth hydraulic passage 289 provides hydraulic communication between the accumulator 290 and the hydraulic volume 226. The control valve 272 is mounted upright in a distal end of the rocker arm 200. The bottom of the control valve 272 includes an extension 279, which may be used in conjunction with an external stop 600 to trigger the control valve 272 to provide hydraulic communication between the third hydraulic passage 234 and the ninth hydraulic passage 288.

More specifically, the system 100 shown in FIGS. 38–40 operates as follows. During positive power operation, no significant hydraulic pressure is provided in the control passage 310. The absence of significant hydraulic pressure in the control passage 310 permits the spring 276 to bias the spool 274 upward into a position that provides hydraulic communication between the upper hydraulic chamber 226 and the ninth hydraulic passage 288, which in turn communicates with the accumulator piston 290. Hydraulic communication between the upper hydraulic chamber 226 and the accumulator piston 290 permits the lash piston 210 to translate upward in its bore 224 when the rocker arm 200 rotates downward toward a valve stem (not shown).

The upward motion of the lash piston 210 forces hydraulic fluid in the upper chamber 226 and the ninth passage 288 to be absorbed by the accumulator piston 290. The lash piston 210 may translate upward until accumulator 290 seats against the stop 293. The point at which the lash piston 210 stops its upward movement may be designed to result in the absorption of the all the motion provided to the rocker arm 200 by the engine braking cam lobe. As a result, the lash piston 210 may provide only the main exhaust event associated with the main exhaust cam lobe when there is no hydraulic pressure in the control passage 310. With continued reference to FIGS. 38–40, hydraulic pressure is supplied to the control passage 310 to institute engine braking operation. The presence of hydraulic pressure in the control passage 310 causes the spool 274 to translate downward against the bias of the spring 276. In this position, the spool 274 cuts off communication between the upper hydraulic chamber 226 and the ninth passage 288. The flow of hydraulic fluid out of the upper hydraulic chamber 226, however, is blocked by the check valve 291 in passage 289 during the initial downward movement of the rocker arm 200 under the influence of the engine braking cam lobe. As a result, the engine braking valve event is transmitted by the rocker arm 200 to the engine valve (not shown).

As the rocker arm 200 continues to move downward under the influence of the main exhaust cam lobe, the spool extension 279 may contact the external stop 600. This contact forces the spool 274 upward until hydraulic communication is reestablished between the upper hydraulic chamber 226 and the accumulator 290 through the ninth hydraulic passage 288. This hydraulic communication allows the upper hydraulic chamber 226 to vent and the lash piston 210 to collapse upward into its bore 224. As a result the motion of the engine valve during the main exhaust event may be reset or clipped, depending upon the point at which the upper hydraulic chamber 226 is vented. As the rocker arm 200 returns to base circle of the cam 400, the spool 274 will again move down from fluid pressure from passage 232. This again blocks the communication between 226 and 288. But at this position, passage 234 is in communication with the accumulator 290 through the passage 289 and the check valve 291, which allows the fluid to return to the volume 226. The movement of the spool 274 to reset or clip the engine valve motion may be repeated with each revolution of the cam during engine braking operation.

It will be apparent to those skilled in the art that variations and modifications of the present invention can be made without departing from the scope or spirit of the invention. For example, the lash pistons, tappets, rocker arms, rocker arm shafts, and hydraulic passages therein, contemplated as being within the scope of the invention include those of any shape or size so long as the elements in combination provide the functions described in the specification. Furthermore, it is contemplated that the scope of the invention extends to variations of the hydraulic passages shown in the drawing figures, and that it should be appreciated that each passage may have an enlarged end opening as may be needed to perform the described functions of the passage. It is further contemplated that any hydraulic fluid may be used in a system configured in accordance with the invention. It is still further contemplated that the various embodiments of the invention may be used in either a unitary cam engine braking arrangement or a dedicated cam engine braking arrangement. Furthermore, each embodiment of the invention may be varied to include or not include, as desirable, a control valve and/or an accumulator piston, located in the rocker arms described, or remotely. The control valves that utilize a spool and a check valve incorporated therein, may be provided as a separate spool and check valve. These control valves may be oriented vertically as shown in FIG. 21 for example, or oriented horizontally and actuated by a fixed (or movable) stop located next to a side of the rocker arm. It is also contemplated and understood that all of the embodiments of the invention may be used outside of the engine braking field. For example, the system may be used for internal EGR. Thus, it is intended that the present invention cover the modifications and variations of the invention, provided they come within the scope of the appended claims and their equivalents.

We claim:

1. An engine braking system, for providing a compression release valve event in an internal combustion engine, comprising:

a rocker arm shaft;

a hydraulic relief passage formed in the rocker arm shaft;

a rocker arm having a central bore adapted to receive the rocker arm shaft, a piston bore, and an internal hydraulic passage connecting the piston bore to a surface port at the central bore;

means for pivoting the rocker arm on the rocker arm shaft to provide a compression release valve event; and a lash piston disposed in a piston bore in the rocker arm, said lash piston being adapted to open an engine valve for the compression release event;

wherein selective hydraulic communication between the hydraulic relief passage and the internal hydraulic passage at the surface port is adapted to release hydraulic fluid from the piston bore.

2. An engine braking system, for providing a compression release valve event in an internal combustion engine, comprising:

a first rocker arm having a piston bore and an internal hydraulic passage connecting the piston bore to a surface port on the first rocker arm;

an adjacent member to the first rocker arm selected from the group consisting of: a rocker arm shaft, a rocker arm shaft pedestal, a second rocker arm, a sleeve, a ring, and a follower arm;

an hydraulic relief opening formed in the adjacent member;

means for pivoting the rocker arm to provide a compression release valve event; and an expandable hydraulic tappet disposed in the piston bore in the rocker arm, said tappet being adapted to open an engine valve for the compression release event;

wherein selective hydraulic communication between the hydraulic relief opening and the internal hydraulic passage at the surface port is adapted to release hydraulic fluid from the piston bore.

3. The engine braking system of claim 2 further comprising a control valve provided in a control valve bore in the internal hydraulic passage in the first rocker arm.

4. The engine braking system of claim 1 wherein the tappet comprises:

an outer piston;

an inner piston slidably received in an outer piston; and a spring disposed in said inner piston and separating said inner and outer pistons.

5. The engine braking system of claim 1 wherein the means for pivoting comprises a cam.

6. The engine braking system of claim 2 wherein the relief passage includes an enlarged opening at the intersection of the relief passage and the adjacent member outer surface.

7. The engine braking system of claim 2, further comprising means for reducing a lash space between the tappet and an engine valve.

8. The engine braking system of claim 2, further comprising an hydraulic accumulator in communication with the relief passage.

9. An engine braking system for providing a compression release valve event in an internal combustion engine, comprising:

a rocker arm shaft;

a hydraulic passage formed in the rocker arm shaft, said relief passage communicating with an outer surface of the rocker arm shaft;

a rocker arm having a central bore adapted to receive the rocker arm shaft;

means for pivoting the rocker arm on the rocker arm shaft to provide a compression release valve event;

an expandable hydraulic tappet disposed in a piston bore in the rocker arm, said tappet being adapted to open an engine valve for the compression release event;

means for providing hydraulic fluid to the tappet; and means for providing selective hydraulic communication between the tappet and the relief passage responsive to pivoting of the rocker arm, wherein the means for providing hydraulic fluid to the tappet comprises a control valve provided in a control valve bore in the rocker arm first passage formed in the rocker arm and a first passage extending between the piston bore and the control valve bore, and wherein the means for providing selective hydraulic communication between the relief passage and the tappet comprises a second passage formed in the rocker arm extending between the first passage and the central bore.

10. The engine braking system of claim 9 further comprising a check valve disposed in the second passage.

11. The engine braking system of claim 9 wherein the second passage includes an enlarged opening at the intersection of the second passage and the central bore.

12. The engine braking system of claim 11 wherein the relief passage includes an enlarged opening at the intersection of the relief passage and the rocker arm shaft outer surface.

13. The engine braking system of claim 9, further comprising a third passage formed in the rocker arm extending between the control valve bore and the central bore.

14. The engine braking system of claim 13 wherein said means for reducing lash space comprises:

a fourth passage formed in the rocker arm extending between the central bore and the piston bore; and a check valve disposed in the fourth passage.

15. The engine braking system of claim 14 further comprising a lash passage formed in the rocker arm shaft adapted to provide hydraulic fluid to the fourth passage in the rocker arm.

16. The engine braking system of claim 13 further comprising one or more drain passages in the control valve bore, wherein the control valve is adapted to transfer hydraulic fluid to the first passage and block the one or more drain passages in the control valve bore when hydraulic fluid is applied to the control valve from the third passage.

17. The engine braking system of claim 16 wherein the control valve comprises a spool valve.

18. The engine braking system of claim 16, further comprising a control passage formed in the rocker arm shaft adapted to provide hydraulic fluid to the third passage in the rocker arm.

19. The engine braking system of claim 18, further comprising a solenoid valve adapted to selectively provide hydraulic fluid to the control passage.

20. An engine braking system, for providing an engine valve actuation event in an internal combustion engine, comprising:

a rocker arm shaft;

a rocker arm mounted on the rocker arm shaft, said rocker arm including a piston bore, a control valve bore, an accumulator bore, a first hydraulic passage connecting the piston bore to the control valve bore, a second hydraulic passage connecting an upper portion of the control valve bore to the accumulator bore, and a third hydraulic passage connecting a lower portion of the control valve bore to a central portion of the second hydraulic passage;

a control valve slidably disposed in the control valve bore;

a lash piston slidably disposed in the piston bore; and an accumulator piston disposed in the accumulator bore.

21. The system of claim 20 further comprising:

a spring biasing the control valve into the control valve bore; and a control valve extension extending from the control valve out of the control valve bore.

22. The system of claim 20 further comprising means for preventing the flow of hydraulic fluid from the control valve bore through the third hydraulic passage to the second hydraulic passage.

23. The system of claim 20 further comprising means for forcing the control valve into a position that blocks hydraulic communication between the first and second hydraulic passages, and permits hydraulic communication between the first and third hydraulic passages.

24. An engine braking system, for providing a compression release valve event in an internal combustion engine, comprising:

a first rocker arm having a piston bore and an internal hydraulic passage connecting the piston bore to a surface port on the first rocker arm;

an adjacent member to the first rocker arm selected from the group consisting of: a rocker arm shaft, a rocker arm pedestal, a second rocker arm, a sleeve, a ring, and a follower arm;

a hydraulic relief opening formed in the adjacent member;

means for pivoting the rocker arm to provide a compression release valve event; and a lash piston disposed in the piston bore in the rocker arm, said lash piston being adapted to open an engine valve for the compression release event;

wherein selective hydraulic communication between the hydraulic relief opening and the internal hydraulic passage at the surface port is adapted to release hydraulic fluid from the piston bore.

25. The engine braking system of claim 24 wherein the lash piston comprises a solid piston.

26. The engine braking system of claim 24 wherein the lash piston includes an interior chamber.

27. The engine braking system of claim 24 wherein the selective hydraulic communication is established responsive to movement of the first rocker arm.

28. The engine braking system of claim 24 wherein the hydraulic relief opening comprises a hydraulic relief passage.

29. The engine braking system of claim 24 wherein the hydraulic relief opening comprises a window passage.

30. The engine braking system of claim 24 wherein the selective hydraulic communication is established responsive to movement of the adjacent member.

31. The engine braking system of claim 30 wherein movement of the adjacent member is responsive to movement of a cam.

32. A method of providing engine braking in an internal combustion engine using a rocker arm having a hydraulic lash piston integrated in an end of the rocker arm, said method comprising the steps of:

providing the rocker arm next to an adjacent member selected from the group consisting of: a rocker arm shaft, a rocker arm pedestal, a second rocker arm, a sleeve, a ring, and a follower arm, said adjacent member having a relief opening incorporated therein and said rocker arm having an internal hydraulic passage providing selective communication between the relief opening and the lash piston;

providing hydraulic fluid to the lash piston during an engine braking mode of engine operation, thereby taking up lash between the lash piston and an engine valve;

opening the engine valve responsive to movement of the rocker arm and the provision of hydraulic fluid to the lash piston, to carry out an engine braking event; and terminating the engine braking event responsive to relative motion between the rocker arm and the adjacent member to thereby selectively establish hydraulic communication between the internal hydraulic passage in the rocker arm and the relief opening in the adjacent member.

33. The method of claim 32 wherein the step of terminating comprises the step of clipping the engine braking event.

34. The method of claim 32 wherein the step of terminating comprises the step of resetting the engine valve.

35. An engine braking system, for providing a compression release valve event in an internal combustion engine, comprising:

a rocker arm having a central bore, a lash piston, a control valve, an accumulator piston;

an internal hydraulic passage in the rocker arm extending between the lash piston, the control valve, and the accumulator piston;

means for pivoting the rocker arm to provide an engine braking valve event;

means for biasing the control valve into a closed position during an engine braking mode; and means for selectively opening the control valve during the engine braking mode.

36. The engine braking system of claim 35 wherein the means for biasing the control valve into a closed position comprises a hydraulic control passage in the rocker arm extending between the control valve and the central bore.

37. The engine braking system of claim 35 wherein the means for selectively opening the control valve comprises an external stop.

38. The engine braking system of claim 35 wherein the means for selectively opening the control valve comprises a follower arm.

* * * * *